US005619004A

United States Patent [19]

Dame

[11] Patent Number: 5,619,004

[45] Date of Patent: Apr. 8, 1997

[54] METHOD AND DEVICE FOR DETERMINING THE PRIMARY PITCH OF A MUSIC SIGNAL

[75] Inventor: Stephen G. Dame, Everett, Wash.

[73] Assignee: Virtual DSP Corporation, Everett, Wash.

[21] Appl. No.: 474,558

[22] Filed: Jun. 7, 1995

[51] Int. Cl.[6] ..... G10H 7/00

[52] U.S. Cl. ..... 811/616; 84/603; 84/654; 395/216

[58] Field of Search ..... 84/603, 616, 654; 395/2.16, 2.17; 381/38

[56] References Cited

U.S. PATENT DOCUMENTS

| | | | |
|---|---|---|---|
| 3,947,638 | 3/1976 | Blankinship . | |
| 4,377,961 | 3/1983 | Bode . | |
| 4,627,323 | 12/1986 | Gold . | |
| 4,688,464 | 8/1987 | Gibson et al. . | |
| 4,817,484 | 4/1989 | Iba et al. . | |
| 4,841,827 | 6/1989 | Uchiyama . | |
| 5,140,890 | 8/1992 | Elion . | |
| 5,210,366 | 5/1993 | Sykes, Jr. . | |
| 5,270,475 | 12/1993 | Weiss et al. . | |
| 5,353,372 | 10/1994 | Cook et al. | 395/2.16 |
| 5,428,708 | 6/1995 | Gibson et al. | 395/2.16 X |

OTHER PUBLICATIONS

Shadow Electronics of America, Inc., date uknown, SH 075 Quick Mount Guitar MIDI System brochure.
Wildcat Canyon Software, date uknown, Realtime Music Recognition Software—Autoscore brochure.
Lyrrus, Inc., 1992, G–VOX brochure, "Play with it".
Roland Corp US, 1993, GR–1 Guitar Synthesizer brochure.
Roland Corp US, 1991, GR–50 Guitar Synthesizer/GK–2 Synthesizer Driver brochure.
Roland Corp US, 1993, GR–90 Guitar Synthesizer brochure.
Roland Corp US, 1994, GI–10 MIDI Interface brochure.

*Primary Examiner*—William M. Shoop, Jr.
*Assistant Examiner*—Jeffrey W. Donels
*Attorney, Agent, or Firm*—Graybeal Jackson Haley LLP

[57] ABSTRACT

A method and device for very quickly and accurately determining the fundamental frequency of an input analog electrical signal. The method first uses sparse range autocorrelation to determine the note which is closest to the fundamental frequency. It then uses fine range autocorrelation and interpolation to calculate more precisely the exact pitch. Smoothing is employed for both the sparse range determination and the subsequent fine range determination to reject spurious signals. Because the sparse autocorrelation produces good results with merely one or two full cycles of the fundamental frequency, the initial sparse determination can be made in less than ten milliseconds and this is updated with a fine determination less than two milliseconds later.

45 Claims, 14 Drawing Sheets

| Lag Index | Note Name | Freq | Lag | Lag Index | Note Name | Freq | Lag |
|---|---|---|---|---|---|---|---|
| 1 | E | 82.4Hz | 194.16 | 2 | F | 87.3Hz | 183.26 |
| 3 | F# | 92.5Hz | 172.98 | 4 | G | 98.0Hz | 163.27 |
| 5 | G# | 103.8Hz | 154.10 | 6 | A | 110.0Hz | 145.45 |
| 7 | A# | 116.5Hz | 137.29 | 8 | B | 123.5Hz | 129.59 |
| 9 | C | 130.8Hz | 122.31 | 10 | C# | 138.6Hz | 115.45 |
| 11 | D | 146.8Hz | 108.97 | 12 | D# | 155.6Hz | 102.85 |
| 13 | E | 164.8Hz | 97.08 | 14 | F | 174.6Hz | 91.63 |
| 15 | F# | 185.0Hz | 86.49 | 16 | G | 196.0Hz | 81.63 |
| 17 | G# | 207.7Hz | 77.05 | 18 | A | 220.0Hz | 72.73 |
| 19 | A# | 233.1Hz | 68.65 | 20 | B | 246.9Hz | 64.79 |
| 21 | C | 261.6Hz | 61.16 | 22 | C# | 277.2Hz | 57.72 |

FIG. 8

METHOD AND DEVICE FOR DETERMINING THE PRIMARY PITCH OF A MUSIC SIGNAL

This invention relates to the field of electronic musical devices for receiving an electric signal with musical content and determining the primary pitch or fundamental frequency of the signal at any point in time to generate a stream of data representing the music, typically in MIDI format.

BACKGROUND

With the advent of low cost computers, musicians sought a way to use a computerized system to capture data representing the keys played by a musician on an electronic keyboard as an electronic representation of music much like a printed score. The most common format for such data representing music is "MIDI", an acronym for musical instrument digital interface. Because the electronic keyboard generates an electric signal when each key is pressed, MIDI data can be generated from such a keyboard instantaneously so that the MIDI data can then be used to drive synthesizers to instantaneously produce desired music.

Musicians also want to use other sources to generate musical data, such as guitars, non-electronic instruments, and the human voice. Analog and digital circuits, including computer software methods on a general purpose computer, for determining the primary pitch or fundamental frequency of a musical source are well known. However, most of them do not have a quick enough response time to be used for generating sound from a synthesizer while the musician is playing and giving to the musician immediate feedback with the synthesized sound. Because of the lag time of processing, such systems are mostly used for creating musical data recordings or, with a lag from the original music creation, displaying on a computer screen a score which represents the music. These systems use methods involving the detection of either peaks at the highest and lowest values of the signal or zero crossings at the midpoint of the signal and measuring time durations between these events to determine the fundamental frequency. Recently, Roland Corporation has developed an improved high speed signal processing circuit for determining the primary pitch of each of numerous guitar strings and producing musical data with a short delay. However, because the circuits are optimized to operate quickly, the data output often contains errors which will cause the sound synthesizer to generate the incorrect sound, and further reduction in the delay is still desired.

SUMMARY

The invention is a novel method and device for determining the primary pitch of any musical electric signal. Instead of looking at detectable events in the signal, such as peaks or zero crossings, the method looks at the entire signal over a duration of between one and two periods of the primary pitch and compares the signal to many copies of itself, each with a lag shift. When the comparison finds the closest match, this is determined to be the primary pitch period.

To obtain a result as quickly as possible, the autocorrelation lags that are considered are those which correspond to the pitch periods for the notes that are expected. On any particular instrument, musicians seldom range beyond two octaves for a single voice of the instrument. In standard tuning, this is twenty-four notes for which an autocorrelation lag should be examined. For a guitar embodiment, twenty-two notes are examined, ranging from low E to high C#.

Whichever one of these notes has a lag value which produces the best autocorrelation match is determined to be the proper note.

Because many instruments allow the musician to bend the note to a slightly higher or lower pitch, the initial determination of the nearest standard tuning note is followed by a precise determination of the pitch period by mathematically fitting a curve to the match values produced by autocorrelation of five lags surrounding the note and calculating the true pitch as the peak of the curve.

To minimize errors, the system includes temporal smoothing of calculated values, both for the initial note determination and for the precise pitch determination.

The autocorrelation values for each lag are calculated by multiplying together each pair of digitized data points to be compared and summing these products. The sum that is the greatest is taken to be the best match. To reduce computational complexity and increase speed, the invention includes a novel method of performing subsequent calculations for the same lag value after the first calculation for a particular lag value. The method comprises subtracting the product of the added data point and another data point from the former value for that lag and adding the product of a new data point and one of the earlier data points to produce the updated value for that lag.

Because the sparse autocorrelation produces good results with merely one or two full cycles of the fundamental frequency, the initial sparse determination can be made in less than ten milliseconds, and this is updated with a fine determination less than two milliseconds later.

BRIEF DESCRIPTION OF THE DRAWINGS

FIG. 8 shows a look up table for selecting the lags to be used for the sparse autocorrelation.

DETAILED DESCRIPTION OF THE PREFERRED EMBODIMENT

Figure 1:
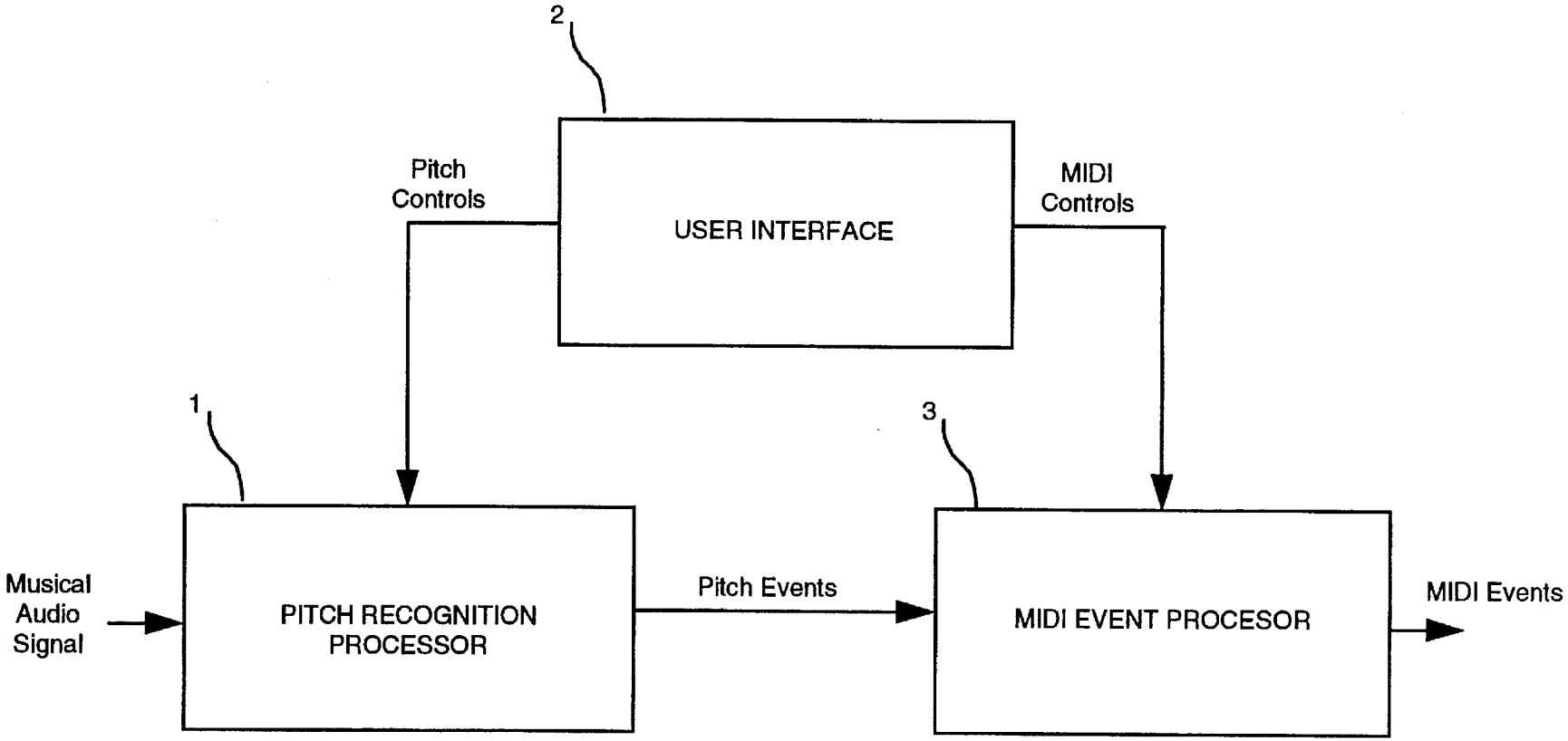
FIG. 1 is a high level block diagram of a typical pitch to MIDI system.

FIG. 1 illustrates the basic system that is used to transform musical audio signals into discrete pitch or MIDI events. Audio signals from a musical instrument that have been conditioned by a transducer and amplifier (and possibly analog to digital converter) are input to the pitch recognition processor which is controlled by a user interface 2 and outputs pitch events to a MIDI event processor 3. Although a guitar is used as a convenient instrument for the present invention, it is understood that the invention may be used with other musical instruments with alternate timbres. The pitch detection method will work equally well with many or all musical timbres including the human voice. It is also understood that MIDI is only one of many protocols to communicate musical expression events and the output of this pitch recognition invention shall apply equally well to other musical communication protocols. One such future protocol proposed is the ZIPI network proposed from Zeta Music Systems, Inc. in Berkeley, Calif.

Figure 2:
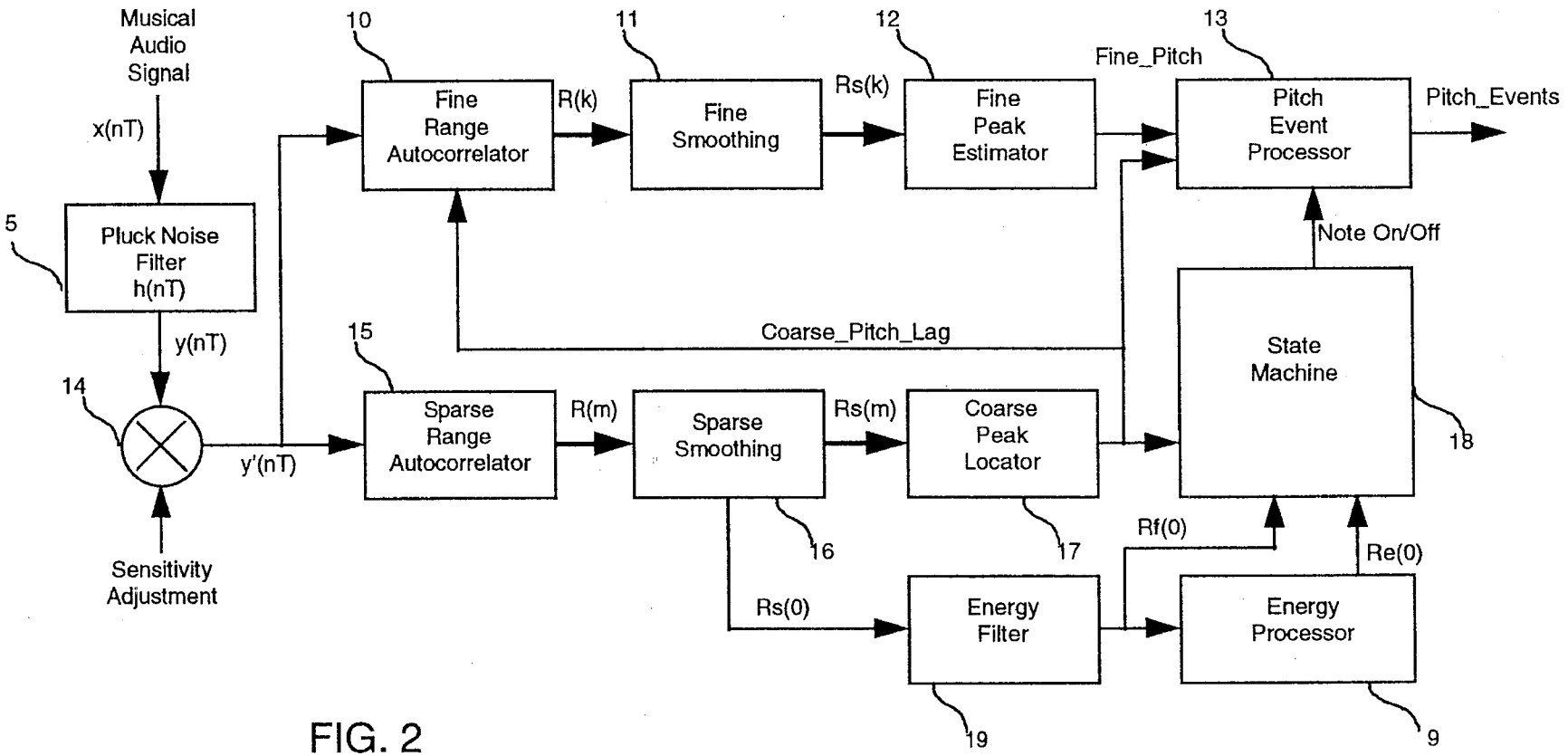
FIG. 2 is a block diagram of the pitch processor method and apparatus of the present invention.

FIG. 2 shows a detailed block diagram for the pitch recognition processor of the present invention. As an explanation of the symbolic names, n signifies an integer sequence in time, m signifies sparse autocorrelation lag values, k signifies fine autocorrelation lag values, T is equal to the inverse of the sampling frequency of the analog input signal, R(i) is the autocorrelation amplitude corresponding to lag i, x(nT) is the input musical electrical signal sampled by an analog to digital converter every T seconds, h(nT) is the impulse response of a suitable lowpass filter for attenuating high frequency components related to string plucking, y(nT) is the output of x(nT) convolved with h(nT) which constitutes filtering x(nT) by the filter h(nT), Rs(i) is a temporally smoothed version of R(i), Rs(0) is the smoothed mean squared energy of the pluck filtered input signal, Rf(0) is a further filtered version of the mean squared energy of the pluck filtered input signal, and Re(0) is a processed version of Rf(0) which is used in extracting state features of the musical event such as the beginning and end of a note.

An input musical signal x(nT) is applied to a pluck noise filter 5 and then the output y(nT) is then applied to a sensitivity adjustment gain which is implemented as a multiplier circuit 14. The gain adjusted signal y'(nT) is applied to the sparse range autocorrelator 15, which produces an array over time of sparse autocorrelation lag values R(m), each of which specifies the nearest standard pitch note. The gain adjusted signal y'(nT) is also applied to the fine range autocorrelator 10, which produces an array of fine autocorrelation lag values R(k) to determine the exact pitch.

The sparse autocorrelation lag values R(m) are applied to a sparse smoother 16 which, via amplitude smoothing, rejects temporally non-coherent aspects of the sparse autocorrelation output values. The output of the sparse smoother 16 Rs(m) is analyzed by a peak locator 17 to find the largest autocorrelation peak, excepting that the autocorrelation of lag 0 will be the largest of all the lag values m. As an alternative embodiment, the order of the sparse smoother 16 and coarse peak locator 17 could be interchanged to yield temporal smoothing of several autocorrelation peak locations, instead of amplitude smoothing of the entire sparse autocorrelation array of values. In this case, the R(0) value would also need to be amplitude smoothed in order to feed the Energy Filter 19. The lag corresponding to the sparse autocorrelation peak location (Coarse_Pitch_Lag) represents a coarse estimate of the period of the musical audio signal to the nearest standard pitch note. The Coarse_Pitch_Lag is fedback to the fine range autocorrelator 10 which uses this value to reference the range of autocorrelation lags needed to estimate a high resolution pitch period. As an example, the peak locator might determine that the largest value of Rs(m) occurs at a lag of 97. This would now be equal to the new Coarse_Pitch_Lag. The fine range autocorrelator 10 would choose 2 equally spaced autocorrelation lags above Coarse_Pitch_Lag and 2 equally spaced autocorrelation lags below Coarse_Pitch_Lag that span the range of ±1 semitone. In this example, this would correspond to lag 85 and lag 91 for the lower lags and lag 103 and lag 109 for the upper lags. The fine range autocorrelator 10 would calculate subsequent autocorrelation values R(k) over each of these discrete lags.

As an alternative higher resolution method, the fine range autocorrelator 10 could choose to operate on the nearest 2 autocorrelation lags (95, 96 and 98, 99 in this example) and track when the distance to the next upper lag (98) or next lower lag (96) was exceeded by a value fedback from the fine peak estimator 12. When this unbalance occurred, the lag furthest away would be dropped, a new local Coarse_Pitch_Lag would be chosen as a new center position for fine autocorrelation calculations, and a new lag would be added on the opposite side of center from the lag that was dropped.

The fine autocorrelation lag values R(k) are also applied to a fine smoother 11 which, via amplitude smoothing, rejects temporally non-coherent aspects of the fine autocorrelation output values and produces an output Rs(k). The output of the fine smoother 11 is applied to a fine peak estimator 12 which provides a quadratic interpolation on the smoothed fine autocorrelation data points Rs(k) to estimate an even higher resolution peak value of the fine autocorrelation data set. As an alternative embodiment, the order of the fine peak estimator 12 and fine smoother 11 could be interchanged to yield temporal smoothing of several high resolution peak locations, instead of amplitude smoothing of the fine autocorrelation array of values, R(k).

The sparse autocorrelation zeroth lag value Rs(0) represents the instantaneous energy of the pluck filtered musical signal y'(nT) but needs additional filtering before it can be properly analyzed. The energy filter 19 is required only in the case where the window of observation of the input data is on the order (or smaller) of the period of the lowest frequency of the musical note recognition range. For these short window durations, fundamental frequency signal leakage causes the Rs(0) signal to contain too much variation. The signal Rs(0) is passed through an energy filter 19 which rejects any frequency components higher than the lowest fundamental frequency found in typical musical instruments. The filtered instantaneous energy signal Rf(0) is then applied to an energy processing block 9 that performs additional slope measurements of Rf(0) and combinational analysis of Rf(0) and the instantaneous slope of Rf(0). The output of the energy processor 9 Re(0) is passed to the pitch processor state machine 18 which provides additional control over all of the above described processing elements of the pitch processor i and provides a definitive Note ON and Note Off event status.

Software Flow Chart

Figure 3:
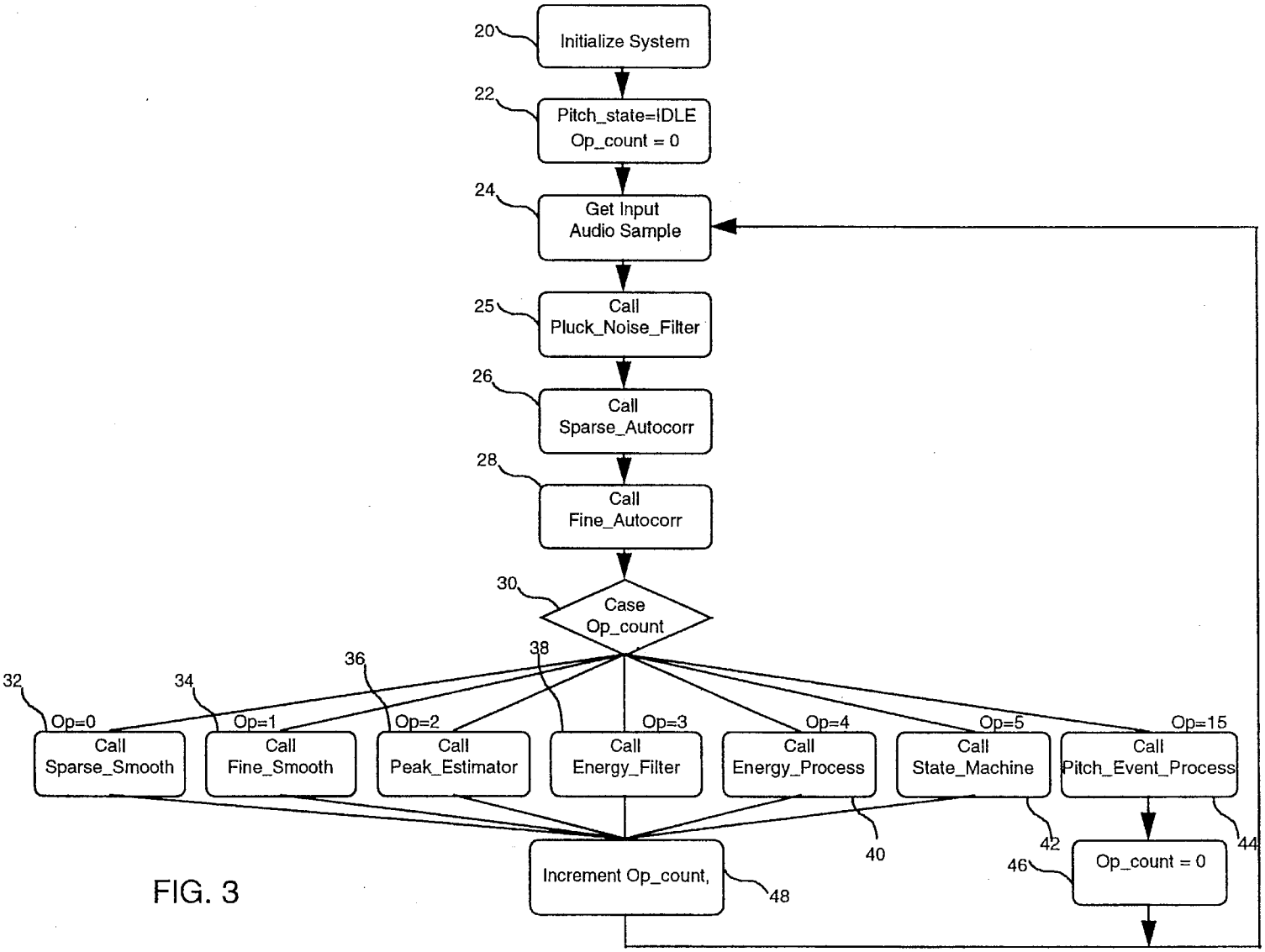
FIG. 3 is a software flow chart for the top level processing control flow in accordance with the present invention.

FIG. 3 shows the software flow chart for the top level processing control flow of the pitch recognition processor of the present invention. The pitch recognition software implements a preferred embodiment of the pitch processor block diagram shown in FIG. 2 but it is understood that the same functionality may be implemented in other hardware forms such as analog circuitry, digital circuitry and application specific integrated circuits (ASICs). As in most general purpose computers there is a system initialization step 20 that occurs when the program begins execution. All of the necessary registers of the hardware are setup at this time as well as default conditions for all of the other processing elements of the pitch recognition processor 1. Two key variables are initialized in step 22 prior to executing the main loop of the pitch process. The Pitch state is initialized to IDLE and Op_count set to 0. Pitch_state controls temporal event processing within the state machine 18 and Op_count provides a method for doing quasi-parallel operations through time multiplexing key operations that do not necessarily have to execute for each sample period. The mainloop is entered at step 24 and is generally performed at a rate corresponding to the input sample rate of the audio signal. It is understood that some systems may not operate on a sample-by-sample basis and buffering of input samples may occur. It is also understood that it is a straightforward optimization of this software flow to "vectorize" the program to operate on a buffer of input samples as opposed to the sample-by-sample flow presented in the preferred embodiment.

Figure 7:
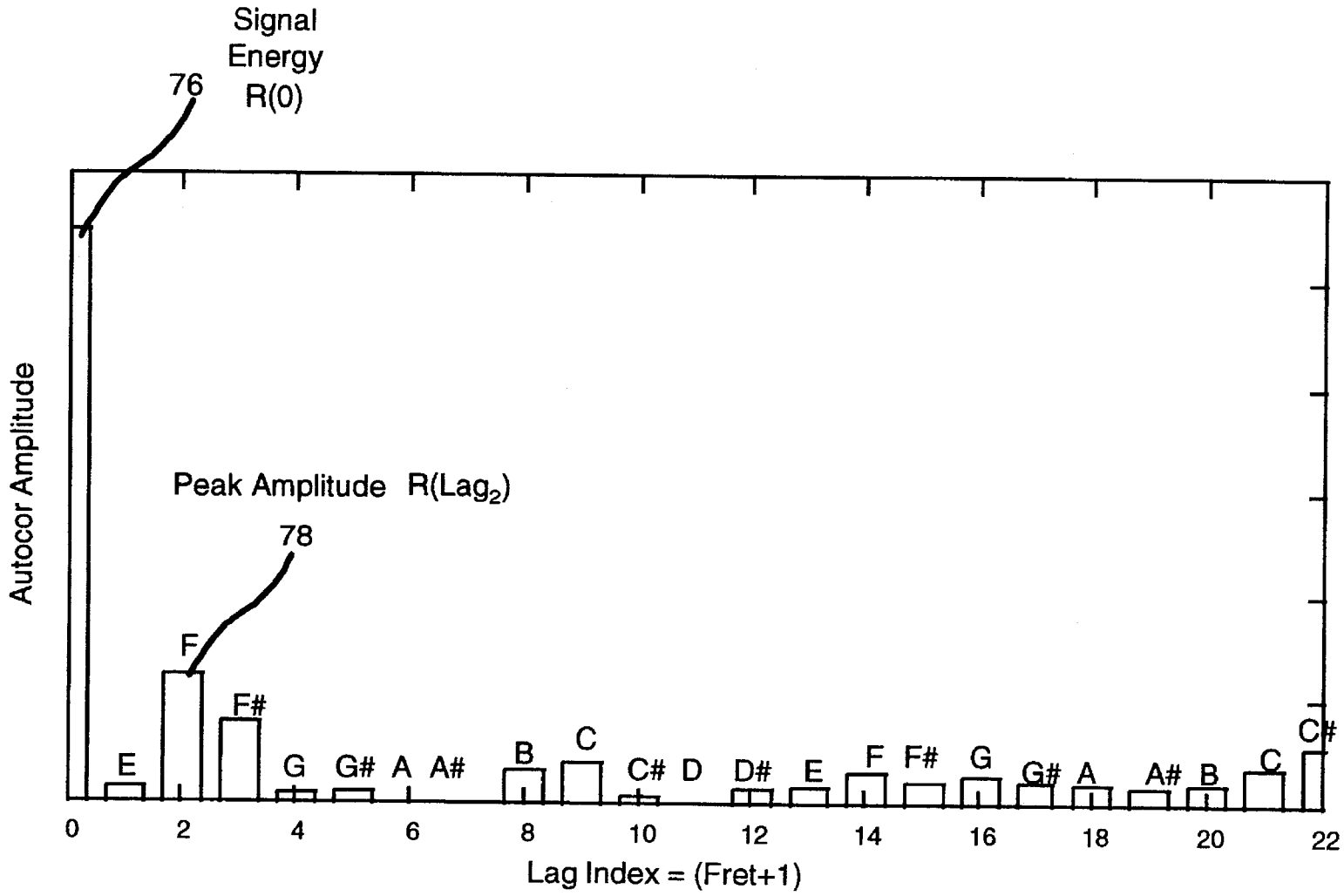
FIG. 7 is a single set of smoothed autocorrelation lag values at an instant in time.

Each input audio sample is retrieved at step 24 and sequential calls are made to the Pluck_Noise_Filter, step 25, Sparse_Autocorrelator, step 26, and the Fine_Autocorrelator, step 28. Internally, the Fine_Autocorrelator subroutine may not actually calculate a set of fine autocorrelation lags if the state machine 18 has not provided the correct gating signal since no fine autocorrelation can be performed until a sparse autocorrelation peak value has been validated by the state machine. This gating signal is provided by calculating the variable coarse_pitch_lag in the State_Machine subroutine, step 42. If coarse_pitch_lag is negative, no fine autocorrelation is performed. A positive Coarse_Pitch_Lag is calculated by performing the operation corresponding to a Coarse Peak Locator, block 17 in FIG. 2. This calculation consists of searching a smoothed sparse autocorrelation array such as the one found in FIG. 7. Starting with lag index of 1, the array is searched for the maximum value. The index of the largest value 78 corresponds to the entry of the autocorrelation lag (in the lag lookup table shown in FIG. 8) yielding the strongest period correlation. The lag index=0 corresponds to the zeroth lag calculation which is the instantaneous signal energy 76.

The Op_count is checked in a case statement, step 30, and additional pitch processing elements are called depending on the state of the Op_count. It is understood that other methods other than a count could be used to provide this multipath switching capability but the Op_count is also used to provide temporal decimation for some of the pitch processes. This results in a decimation of the sample rate of the smoothed autocorrelation lag values which is important for computational efficiency. If the Op_count is nominally 0, then the Sparse_Smooth subroutine, step 32, will be executed. If the Op_count is nominally 1, then the Fine_Smooth subroutine, step 34, will be executed. If the Op_count is nominally 2, then the coarse Peak_Estimator subroutine, step 36, will be executed. If the Op_count is nominally 3, then the Energy Filter subroutine, step 38, will be executed. If the Op_count is nominally 4, then the Energy Process subroutine, step 40, will be executed. If the Op_count is nominally 5, then the pitch process State_Machine subroutine, step 42 will be executed. If the Op_count is nominally 15, then the Pitch_Event_Process subroutine, step 44, will be executed. There are a number of extra states that can be used for other processing optimization by placing subroutine calls in the path of execution when the Op_count is in the range of 6–14. The last operation, Pitch_Event_Process, step 44, occurs when Op_count is 15 and an additional step is executed to reset the Op_count to 0, step 46, prior to executing the next pass of the main loop. All of the other steps of execution go to the step of incrementing the Op_count, step 48, prior to executing the next pass of the main loop.

Pluck Noise Filter The following C programming language code fragment details the lowpass filter operation required for the Pluck_Noise_Filter, step 25.

```
float pluck_state[PLUCK_LPF_ORDER];          // history buffer of samples
float pluck_filter{PLUCK_LPF_ORDER];         // load coeffs here
float *plpf_ptr = &pluck_state[0];           // pluck filter pointer

float pluck_noise_filter(input_sample)
{
  float *px;                                 // pointer to sample values x
  int i;
  float acc,                                 // FIR filter accumulator
    x,                                       // x sample value
    c;                                       // coefficient value

px = plpf_ptr;                               // temporary copy of plpf_ptr

  circ_write(input_sample, &px, pluck_state, PLUCK_LPF_ORDER);
                                             // write new data and bump pointer
  plpf_ptr = px;                             // store new pointer
position

  acc = 0;                                   // zero accumulator before
FIR
  x = circ_read(&px, pluck_state, PLUCK_LPF_ORDER);
  c = pluck_filter[0];

  for(i=1; i < PLUCK_LPF_ORDER; i++)         // FIR filter loop
  {
    acc = acc + x*c;
    x = circ read(&px, pluck_state, PLUCK_LPF_ORDER);
```

-continued

```
26          c = pluck_filter[i];
27        }
28
29        acc = acc + x*c + 0.5;                    // final accum step with rounding
30        return(acc);                              // new filtered value output
sample
31      }
```

On line 2, memory is allocated for storing 89 lowpass filter coefficients for the pluck filter. The coefficients are selected to cut off frequencies above the highest fundamental frequency to be detected. In the preferred embodiment, this is about 750 Hz.

Sparse Autocorrelation

Figure 4:
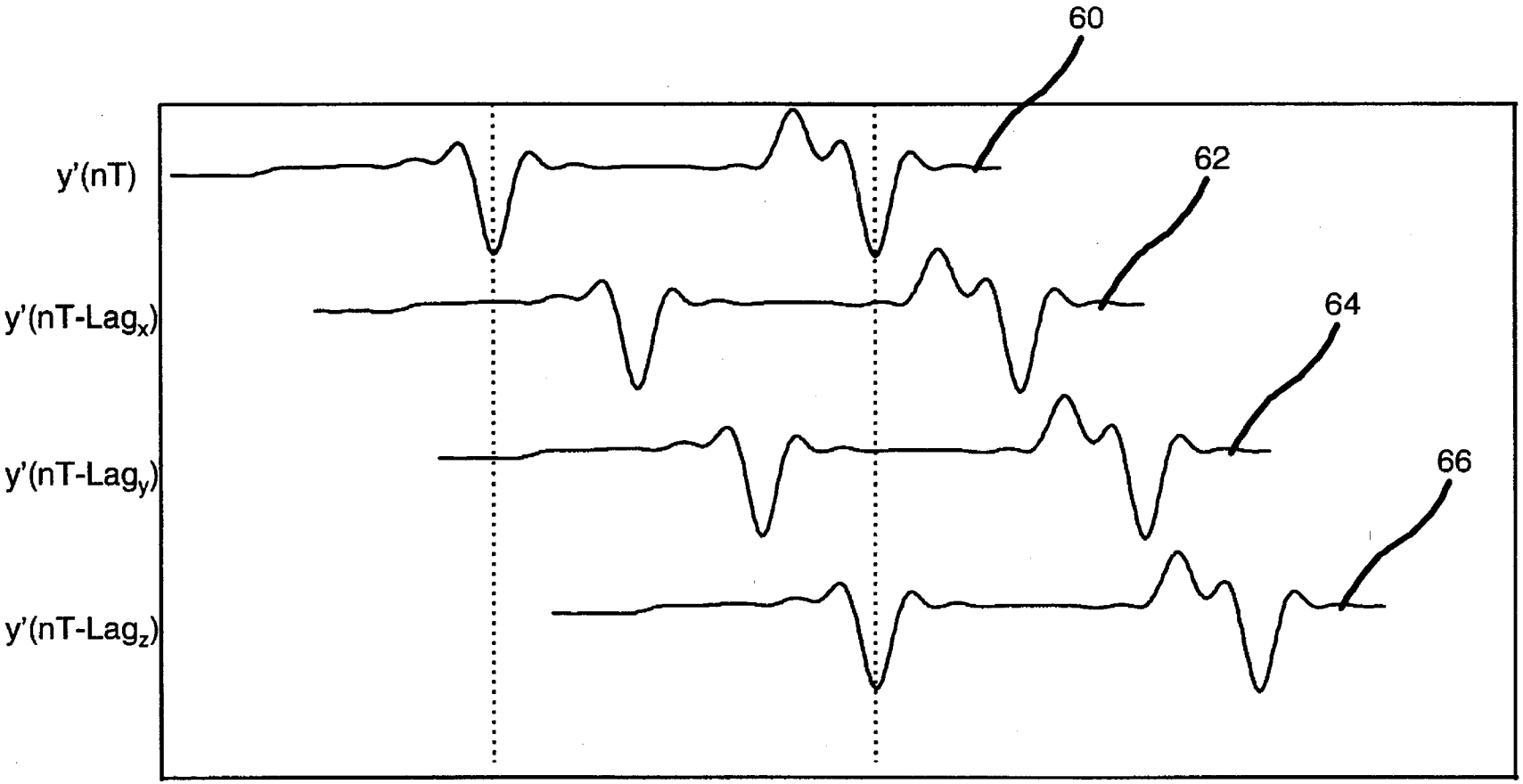
FIG. 4 is a diagram showing various discrete lags of a window of guitar signal data with respect to the reference original guitar signal data.
Figure 5:
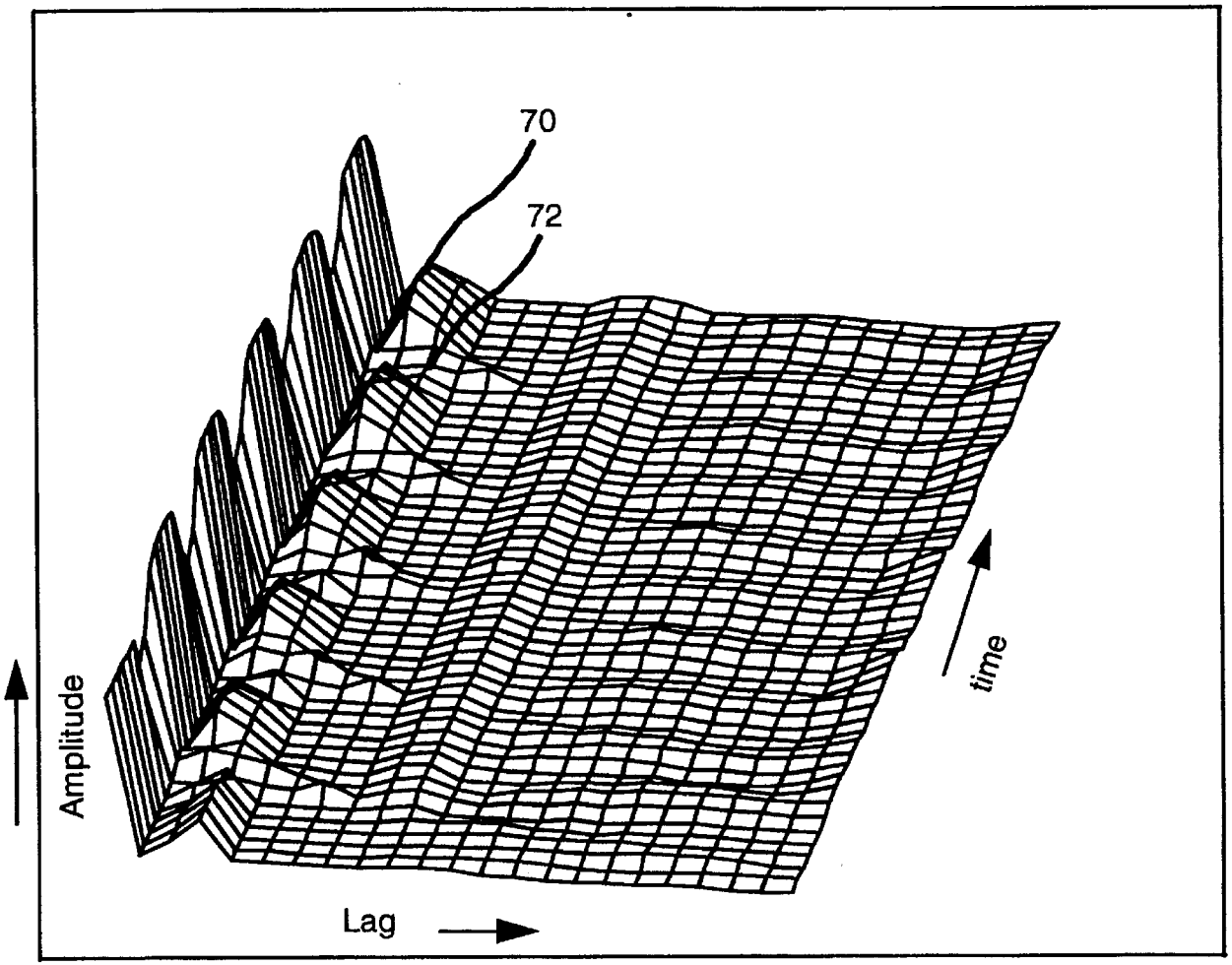
FIG. 5 is a surface plot of a temporally unsmoothed set of autocorrelation lag values obtained from the sampled and pluck noise filtered guitar signal data.
Figure 6:
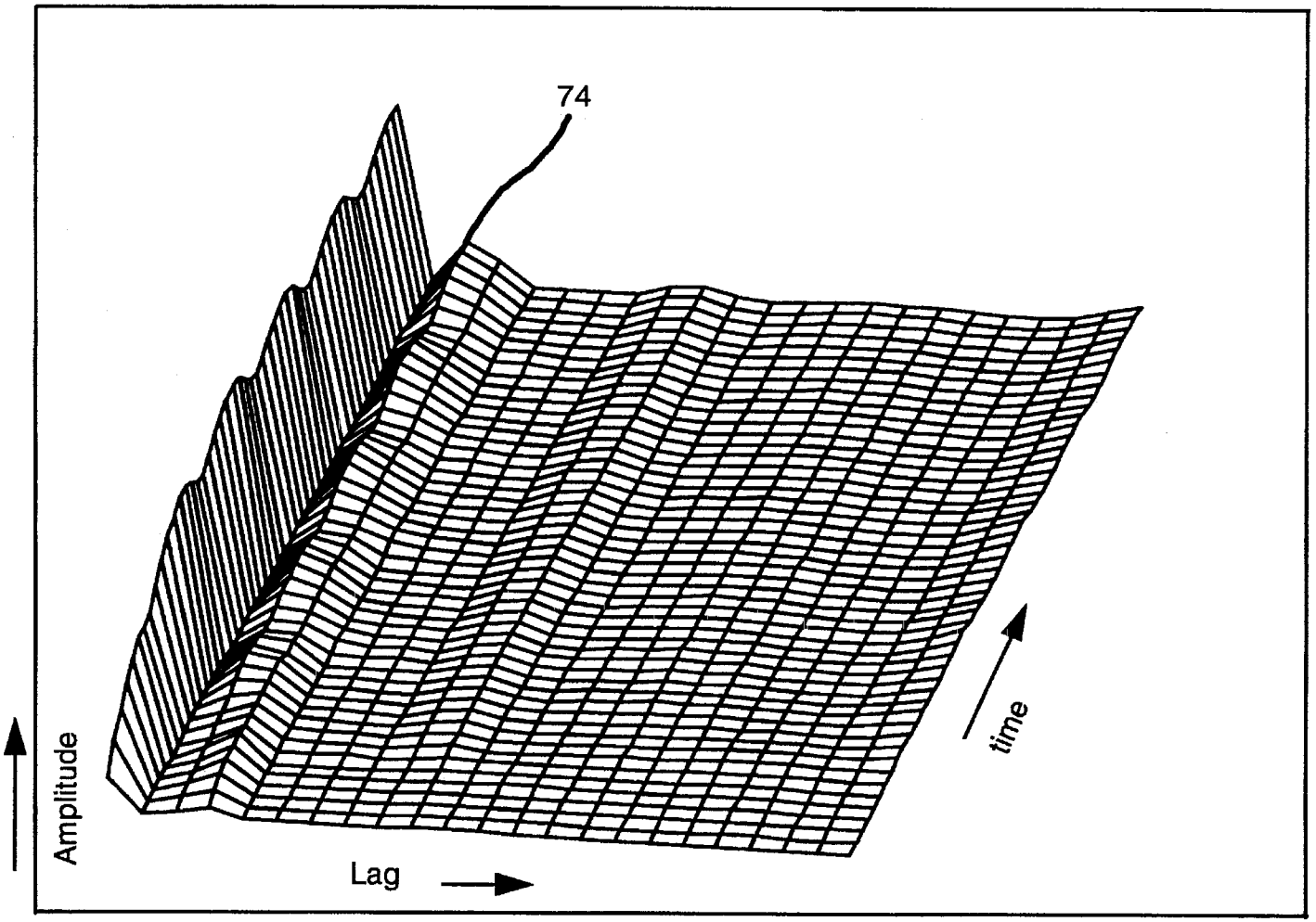
FIG. 6 is a surface plot of a temporally smoothed set of autocorrelation lag values obtained from the sampled and pluck noise filtered guitar signal data.

The output of the Pluck_Noise_Filter, step 25 is passed to the Sparse_Autocorr subroutine, step 26, which, in addition to computing the array of instantaneous sparse autocorrelation lag amplitudes, writes each new data point into a circular buffer which is 384 data points long in the preferred embodiment. It is understood that this buffer length may be optimized for various sample rates and note ranges. In the preferred embodiment this buffer holds approximately 2 fundamental periods of a lower range note of 82 Hz sampled at 16000 Hz. Also, more robust pitch detection may be achieved by increasing the buffer length to more than 2 fundamental pitch periods or less robust pitch detection can be achieved by decreasing the buffer length to a lower limit of 1 fundamental pitch period. Some non-coherent variations, like the ones shown in FIG. 5, induced by reducing the buffer length may also be filtered out in the temporal smoothing subroutines, steps 32 and 34, with a resulting smoother temporal output surface as shown in FIG. 6. It is understood that the present embodiment simply chooses a 2 cycle buffer length as a preferred operating range. FIG. 4 demonstrates graphically the lag process whereby a replica of the signal buffer 60 is delayed in time with respect to the original. Each discrete sparse autocorrelation lag R(m) can be calculated by multiplying the overlap of the original buffer of data 60 and the delayed version at a particular lag m 62, 64 and 66. The delayed lag m is an integer multiple of the sampling time T where T is defined as the reciprocal of the sampling frequency. Practically, this amounts to indexing the samples in the historical input circular buffer at different points as a function of the lag m. The autocorrelation process, for each lag m, is a vector dot product operation whereby the two overlapping vectors of data are multiplied point by point and their total sum is achieved. Data points outside the overlaps are assumed to be zero.

Performing this operation on every filtered input sample produces a highly redundant and computationally expensive set of operations. Therefore, a more efficient method has been developed within the present embodiment that performs the autocorrelation process on more of an incremental basis.

Figure 10:
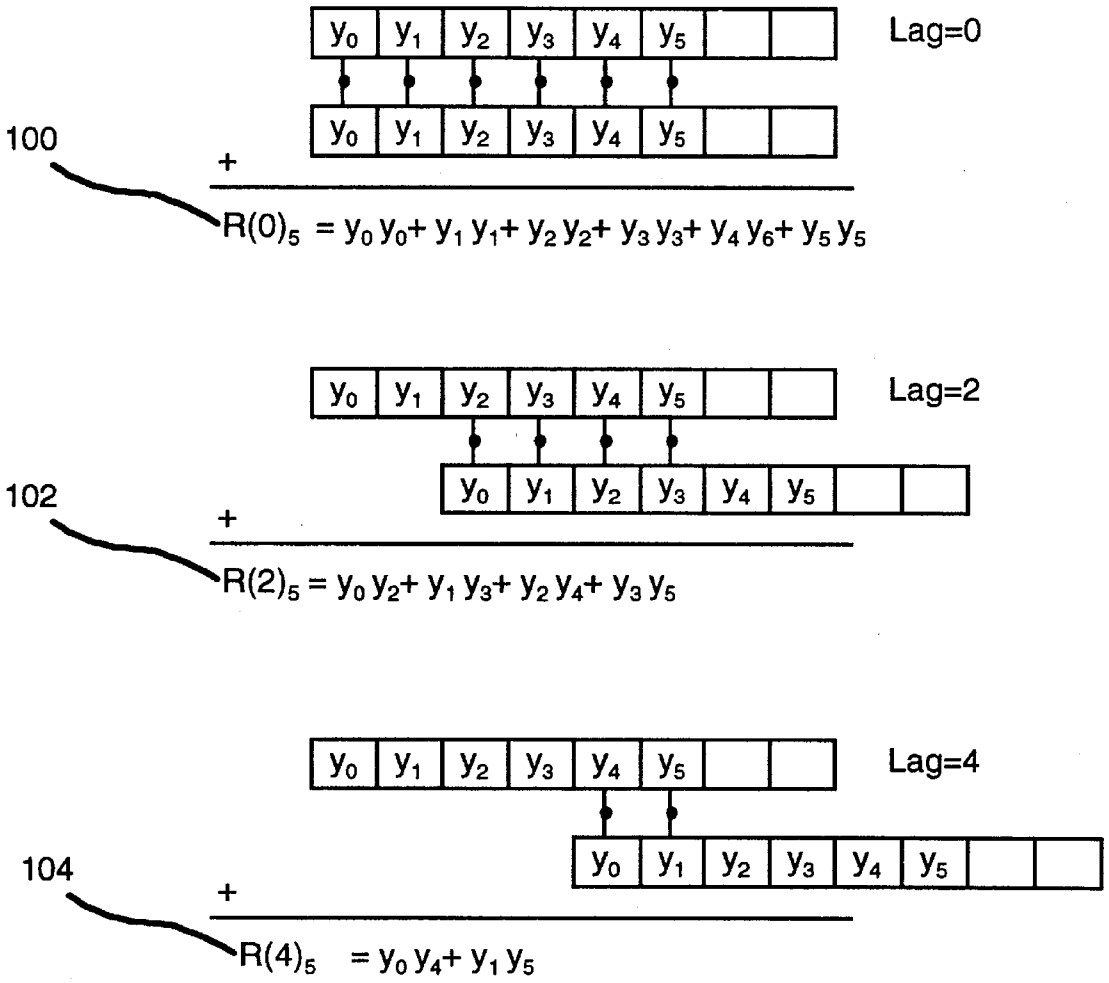
FIG. 10 is an example diagram that outlines the mechanics of performing a sparse autocorrelation.
Figure 11:
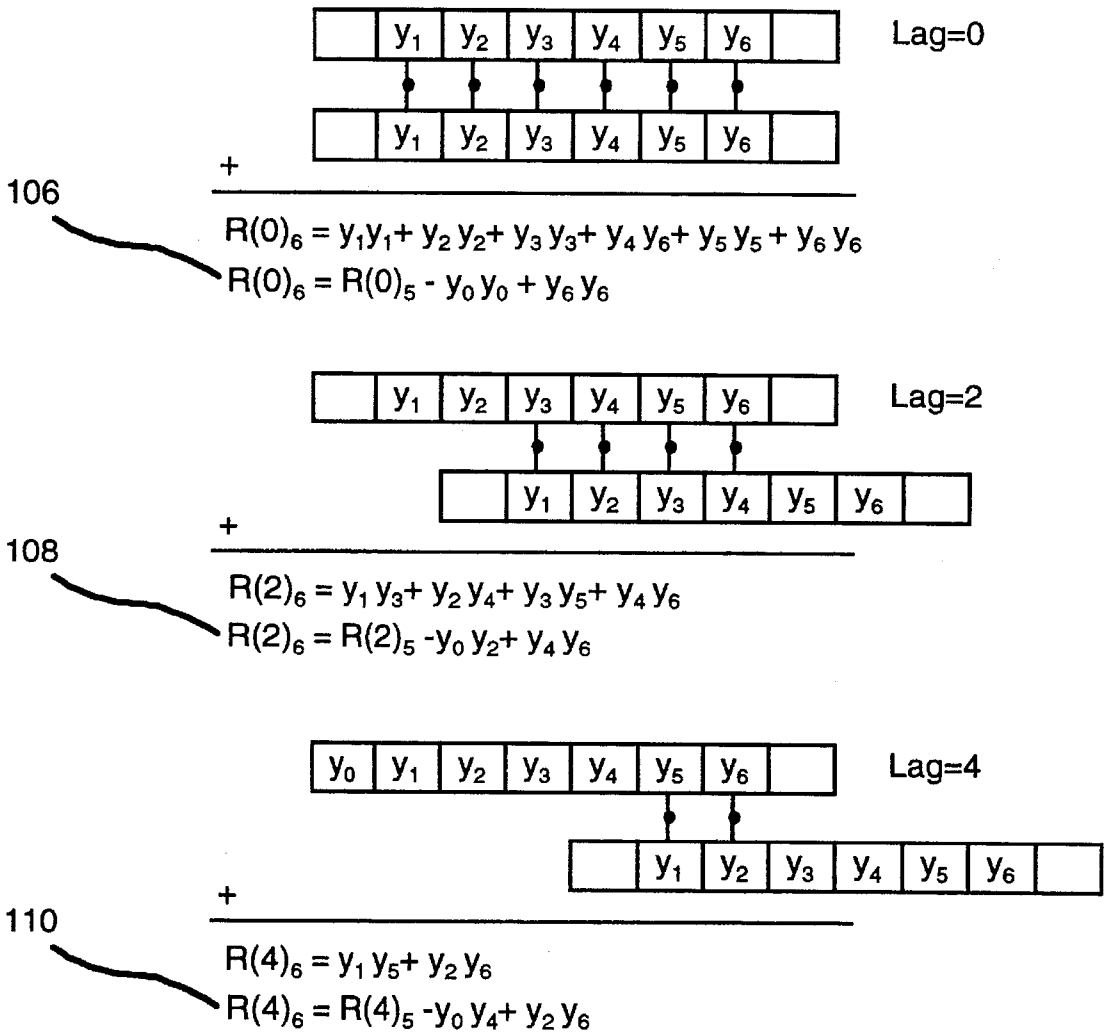
FIG. 11 is an example diagram that shows the next temporal step of the sparse autocorrelator when a new value $Y_6$ is received from the input data stream.

Referring to FIG. 10 it is shown that 3 sparse autocorrelation equations 100, 102 and 104 are computed from an example buffer size of 6 elements. For simplicity, we show the autocorrelation values $R(0)_5$, $R(2)_5$ and $R(4)_5$ calculated by the full equation implementation at time n=5 instead of the more realistic implementation that results from the following incremental optimization. The incremental operation can easily be understood by referring to FIG. 11 and noticing that each autocorrelation value is calculated by subtracting one old product and adding one new product where the new product contains the current input sample. For an example of each of the new autocorrelation values, $R(0)_6$ 106 is computed by subtracting the product $Y_0Y_0$ and adding the product $y_6y_6$, $R(2)_6$ 108 is computed by subtracting the product $Y_0Y_2$ and adding the product $Y_4Y_6$, and $R(4)_6$ 110 is computed by subtracting the product $Y_0Y_4$ and adding the product $Y_2Y_6$.

Figure 12:
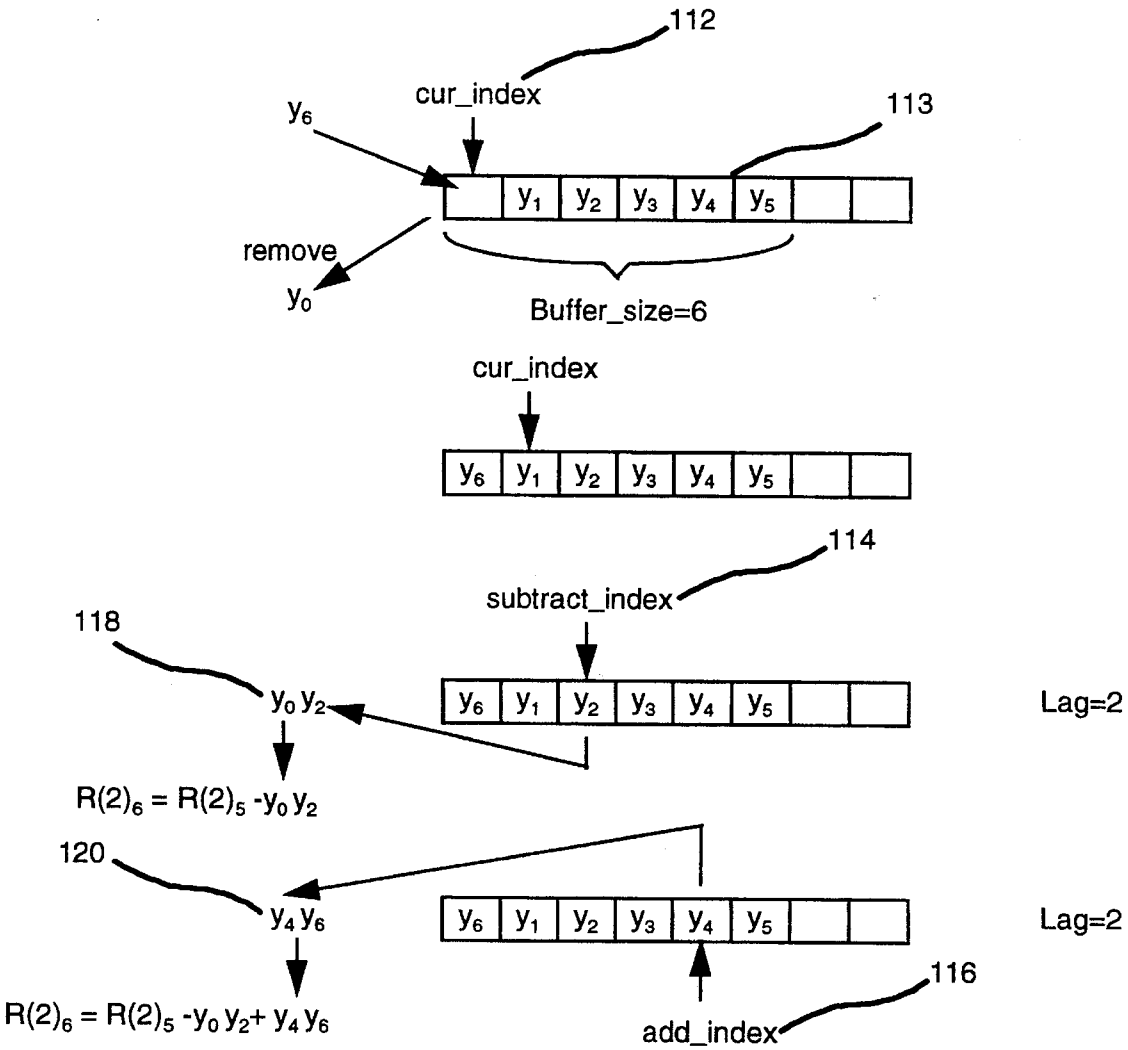
FIG. 12 is an example diagram that outlines the detailed steps required to perform the incremental calculation of the sparse autocorrelation for lag=2.

From a buffer indexing mechanics perspective, each of the lags in the example is shown in FIG. 12. The first operation that occurs when an autocorrelation lag value R(m) is calculated is to remove the oldest element ($Y_0$) from the circular history buffer 113 and place the new value ($y_6$) in the memory location pointed to by cur_index 112. Next, cur_index 112 is advanced (circularly) to the next element in the buffer 113. Next, a subtract_index 114 must be calculated as a function of the lag value m. The subtract_index 114 is the circular sum of the cur_index and lag value less one because the cur_index was already advanced by one after the new value ($y_6$) was written into the circular history buffer. A circular sum C of A and B is defined as $$C=\text{modulo}(A+B, \text{LENGTH})$$

which causes the sum to "wrap around" when the boundaries of the buffer are exceeded. For the example, a subtract_index 114 is calculated as 2 which indexes to $Y_2$. The product $Y_0Y_2$ 118 is then calculated and subtracted from the running accumulation R(2). The add_index 116 is the circular sum of the cur_index and the negative of the lag value plus one because the cur_index was already advanced by one after the new value ($Y_6$) was written into the circular history buffer. A circular sum operator also operates faithfully on the result of the A+B operation being a negative number which causes the numbers to wrap in the opposite direction. For the example, a add_index 116 is calculated as 4 which indexes to $Y_4$. The product $y_4y_6$ 120 is then calculated and added to the running accumulation R(2), at time n=5, to produce the new autocorrelation amplitude for lag=2 at time n=6.

The following C programming language code fragment details the algorithm implementation embodiment required for the Sparse_Autocorr, step 26, function called from the main program flow of FIG. 3.

```
1   #define MAX_LAGS 23 /* includes all lags plus lag=0 (energy) */
2   #define ACOR_LEN 384 /* nominal buffer length */
3   float R[MAX_LAGS]; /* Autocor amplitudes */
4   float acor hist[ACOR_LEN]; /* history of input samples */
5   int cur_index =0; /* start index at being of buff */
6   float old_samp;
7   float autocor_lags[]= /* Table of exact note periods @ Fs=16000Hz */
8   {
9   /* E 82.4Hz */ 194.16, /* F 87.3Hz */ 183.26,
10  /* F# 92.5Hz */ 172.98, /* G 98.0Hz */ 163.27,
11  /* G# 103.8Hz */ 154.10, /* A 110.0Hz */ 145.45,
12  /* A# 116.5Hz */ 137.29, /* B 123.5Hz */ 129.59,
13  /* C 130.8Hz */ 122.31, /* C# 138.6Hz */ 115.45,
14  /* D 146.8Hz */ 108.97, /* D# 155.6Hz */ 102.85,
15  /* E 164.8Hz */ 97.08, /* F 174.6Hz */ 91.63,
16  /* F# 185.0Hz */ 86.49, /* G 196.0Hz */ 81.63,
17  /* G# 207.7Hz */ 77.05, /* A 220.0Hz */ 72.73,
18  /* A# 233.1Hz */ 68.65, /* B 246.9Hz */ 64.79,
19  /* C 261.6Hz */ 61.16, /* C# 277.2Hz */ 57.72
20  };
21
22  void sparse_autocor(float new_samp)
23  {
24
25    int sub_index,
26      add_index;
27    int i,
28      lag;
29
30    old_samp = acor_hist[cur_index];
31    acor_hist[cur_index] = new_samp;
32    cur_index = cur_index + 1;
33    if(cur_index >= ACOR_LEN) cur_index = 0;
34    R[0] =R[0] - old_samp*old_samp + new_samp*new_samp;
35    for (i=0; i < MAX_LAGS-1; i++)
36    {
37      lag = (int)(autocor_lags[i] + 0.5);
38      sub_index = cur_index-1 + lag;
39      if (sub_index >= ACOR_LEN) sub_index = sub_index - ACOR_LEN;
40      add_index = cur_index-1 - lag;
41      if (add_index < 0) add_index = add_index + ACOR_LEN;
42      R[i+1]=R[i+1] - acor_hist[sub_index]*old_samp +
43          acor_hist[add_index]*new_samp;
44    }
45  }
```

On line 1, a constant is defined for the current example range notes to be processed. This range is just under 2 octaves (22 lag values plus lag=0 for calculating the signal energy) but it is understood that this range can be extended to higher numbers of notes by simply increasing the number of lag entries in the lookup table autocor_lags[]. On line 2, the maximum buffer size is defined which sets the depth of history on the input samples to 384. On line 3, memory is allocated to contain the sparse autocorrelation amplitude values R(0). On line 4, a history buffer is allocated to contain the history of input samples. On line 5, the current history buffer index cur index is allocated and set to 0 which is the first element in the history buffer. On line 6, a variable old_samp is declared for holding the sample removed from the history buffer. On lines 7–20, a table of pitch periods for chromatic notes just under 2 octaves is defined based on the input sample rate of 16000 Hz. Each pitch period is calculated by dividing the sampling frequency by the fundamental frequency. On line 22, a function name is declared for the sparse autocorrelation calculation and a parameter new_samp is defined for the input sample. On line 25, a variable sub_index is declared for the subtract_index previously described in FIG. 12. On line 26 a variable add_index is declared for the add_index previously described in FIG. 12. On line 27, a counting variable i is declared. On line 28, a variable for lag lookup is declared. On line 30, old_samp gets set to the oldest sample value in the autocorrelation history buffer (acor_hist) indexed by the current index (cur_index). On line 31, the autocorrelation history buffer (acor_hist) gets the new sample (new_samp) written at the current index location. On line 32 the current index (cur_index)gets incremented. On line 33, the current index (cur_index) value gets wrapped back to zero if it exceeds the buffer length of the acor_hist buffer. On line 34, the running incremental calculation for the energy term R(0) is computed. On line 35, a loop is establish to iterate MAX_LAGS-1times. On line 37, a lag is computed by rounding the floating point value, in the lookup table autocor_lags, to the nearest integer lag value. On line 38, the sub_index is calculated by adding one less than the cur_index to the lag value. On line 39, if the sub_index is greater than the buffer size ACOR_LEN then that value is wrapped back to the appropriate position within the buffer. On line 40, the add_index is calculated by subtracting the lag value from one less than the cur_index value. On line 41, if the add_index is less than zero then that value is wrapped back to the appropriate position within the buffer by adding the ACOR_LEN. On line 42, the autocorrelation amplitude corresponding to the current lag (on each iteration) is calculated by subtracting the product of a value in the acor_hist buffer, at the index location sub_index, times the old_samp and adding the product of a value in the acor_hist buffer, at the index location add_index, times the new_samp.

Fine Autocorrelation

Figure 14:
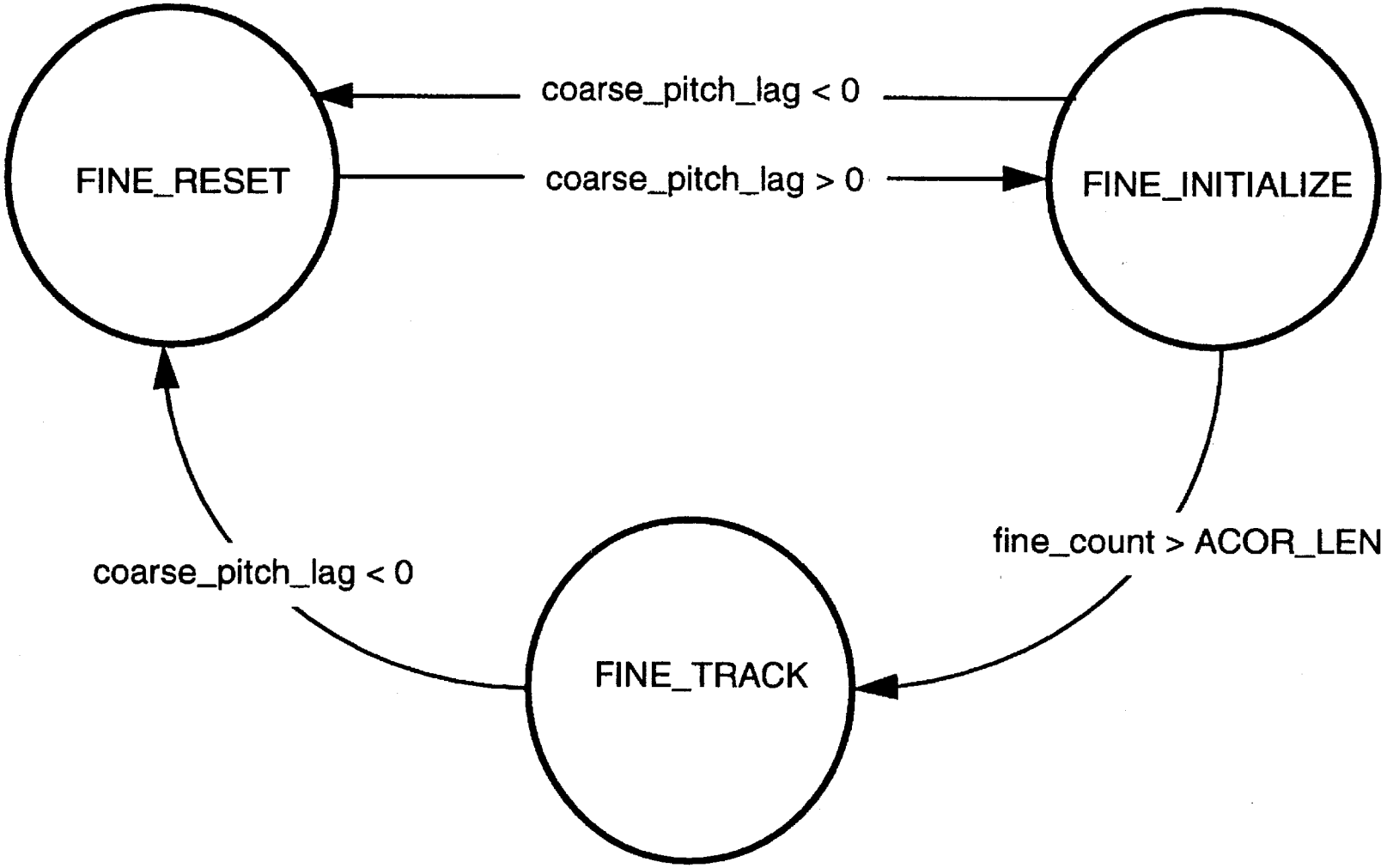
FIG. 14 is a state transition diagram for the fine pitch autocorrelation subroutine.

The Fine_Autocorr function, step 28, is called just after the Sparse_Autocor, step 26, in the main program flow of FIG. 3. This function is called for each input sample but follows an internal state behavior depending on the value of the coarse_pitch_lag variable. The state transition diagram for this behavior is shown in FIG. 14. During the system initialization, step 20, the fine_state variable is set to the FINE_RESET state and the coarse_pitch_lag variable is set to a negative number. The coarse_pitch_lag variable becomes positive only when there is a valid coarse peak located as a sub-function of the State_Machine, step 42. When this positive occurs, the fine_state variable advances the fine pitch state machine to the FINE_INITIALIZE state where 5 fine pitch autocorrelation values are subsequently initialized. It takes ACOR_LEN number of new input samples before the fine autocorrelation values are fully initialized. After ACOR_LEN new inputs are received, the fine_state variable is advanced to FINE_TRACK where the 5 values are continuously calculated similarly to the sparse_autocorrelation values until it is determined that the coarse_pitch_lag variable is invalid (negative). When this occurs, the fine_state variable is set back to the FINE_RESET state to await the next valid (positive) coarse_pitch_lag value. The following C programming language code fragment details the algorithm embodiment required for the Fine_Autocorr, step 28, function.

```
int coarse_pitch_lag; /* global variable for coarse lag */
float F[5]; /* array of 5 fine pitch autocor values */
int fine_state = FINE_RESET;
int fine_count;

void fine_autocor(float new_samp)
{
  int sub_index,
        add_index;
  int i, j;

  switch(fine_state)
  {
    case FINE_RESET;
      for(j=0; j < 5; j++)
      {
        F[j] = 0;
      }
      fine_count = 0;
      if(coarse_pitch_lag > 0) fine_state = FINE_INITIALIZE;
      break;

    case FINE INITIALIZE:
      j = 0;
      for(i=coarse_Pitch_lag-2; i <= coarse_pitch_lag+2; i++)
      {
        add_index = cur_index-1 − i;
        if (add_index < 0) add_index = add_index+ACOR_LEN;
        F[j] = F[j] + acor_hist[add_index]*new_samp;
        j = j + 1;
      }
      fine_count = fine_count + 1;
      if(fine_count > ACOR_LEN) fine_state = FINE_TRACK;
      break;

    case FINE_TRACK:
      j = 0;
      for(i=coarse_pitch_lag-2; i <= coarse_pitch_lag+2; i++)
{
        sub_index = cur_index-1 + i;
        if (sub_index >= ACOR_LEN) sub_index=sub_index_ACOR_LEN;
        add_index = cur_index-1 − i;
        if (add index < 0) add_index = add_index+ACOR_LEN;
        F[j]=F[j] − acor_hist[sub_index]*old_samp +
          acor_hist[add_index]*new_samp;
        j = j + 1;
      }
      if(coarse_pitch_lag < 0) fine_state = FINE_RESET;
      break;
  }
}
```

On line 2, a global variable coarse_pitch_lag is declared for read usage within the Fine_Autocorr module, step 28, and write usage within the system State_Machine, step 42. On line 4, an array of 5 autocorrelation accumulators is declared. On line 6, a fine_state variable is declared for controlling discrete operations within the Fine_Autocorr function. On line 8, a fine_count variable is declared for counting during the FINE_INITIALIZATION state. On line 12, the function fine_autocor is declared and an input argument new_samp is defined. On line 16, a variable sub_index is declared for the subtract_index previously described in FIG. 12. On line 18 a variable add_index is declared for the add_index previously described in FIG. 12. On line 20, counting variables i and j are declared. On line 26, a multiway switch statement is executed depending on the fine_state variable. On line 30, a fine reset case is executed when the fine_state variable is equal to value FINE_RESET. On lines 32–38, a loop is set up to reset the Fine_Autocorr array to zero. On line 40, the fine_count variable is reset to zero. On line 42, the coarse_pitch_lag variable is checked for a positive 20 value, indicating the next fine_state will be to initialize the autocorrelation array values.

On line 46, a fine initialization case is executed when the fine_state variable is equal to value FINE_INITIALIZE. It is noted that state transitions only occur in the next call to fine_autocor after the fine_state variable is changed. On line 48, the autocor array index value j is reset to zero. On line 50, a loop is executed, with the loop variable i initially set to 2 lags below the current value of coarse_pitch_lag, and terminated on the last pass through the loop with i incremented to 2 lags above the current value of coarse_pitch_lag. On line 54, the add_index is calculated by subtracting the lag value from one less than the cur_index value. On line 56, if the add_index is less than zero then that value is wrapped back to the appropriate position within the buffer by adding the ACOR_LEN. On line 58, the autocorrelation amplitude corresponding to the current lag,F[j], is calculated by adding the product of a value in the acor_hist buffer, at the index location add_index, times the new_samp. On line 60, the index variable j is incremented to index the next fine autocorrelation amplitude accumulator F[j]. On line 64, the fine_count is incremented by 1. On line 66, if the fine_count exceeds the ACOR_LEN then the fine_state variable is set to FINE_TRACK.

On line 72, a fine track is executed when the fine_state variable is equal to value FINE_TRACK. On line 74, the autocor array index value j is reset to zero. On line 76, a loop is executed, with the loop variable i initially set to 2 lags below the current value of coarse_pitch_lag, and terminated on the last pass through the loop with i incremented to 2 lags above the current value of coarse_pitch_lag. On line 80, the sub_index is calculated by adding one less than the cur_index to the lag value. On line 82, if the sub_index is greater than the buffer size ACOR_LEN then the value is wrapped back to the appropriate position within the buffer.

On line 84, the add_index is calculated by subtracting the lag value from one less than the cur_index value. On line 86, if the add_index is less than zero then the value is wrapped back to the appropriate position within the buffer by adding the ACOR_LEN. On line 88, the autocorrelation amplitude corresponding to the current lag (on each iteration) is calculated by subtracting the product of a value in the acor_hist buffer, at the index location sub_index, times the old_samp and adding the product of a value in the acor_hist buffer, at the index location add_index, times the new_samp. On line 92, the index variable j is incremented to index the next fine autocorrelation amplitude accumulator F[j]. On line 96, if the coarse_pitch_lag is less than zero then the fine_state variable is returned to the reset state.

As discussed above, the above code fragment uses two lags above and two lags below the coarse peak lag to generate five data points for accurately calculating the pitch. As shown in FIG. 8, the selected lags for the Coarse (or sparse) autocorrelation, step 26, are chosen to be the lags closest to the proper pitch for each of the notes within the range to be detected. Where all the notes to be detected are close to their proper pitch, the above-described embodiment will perform as desired. However, where the system is intended to accurately detect pitches which are halfway between two properly tuned notes, an alternative embodiment is preferred. As shown in FIG. 8, for frequencies above 233 Hz, properly tuned notes are less than four lags apart. Consequently, the true pitch will always fall within the range of two lags above and two below the coarse peak lag. However, for lower frequencies, a pitch which is halfway between two properly tuned notes will not fall within the range of two lags above and two lags below the coarse peak lag. Consequently, the above algorithm is adjusted such that, if the coarse peak lag index falls within the range of 1–8, every third lag above and third lag below the coarse peak lag is selected for use in the fine autocorrelation algorithm. If the lag index number falls within the range of 9–18, the algorithm uses every other lag above and every other lag below the coarse peak lag. If the lag index falls within the range of 19–22, the algorithm uses adjoining lags for the fine pitch calculation.

As an alternative embodiment for the Fine Range Autocorrelator 10, instead of fitting a mathematical curve to the five data points and interpolating the peak of the curve, the system can be simplified to simply choose the lag with the highest autocorrelation value. Because the data is digitized at the rate of 16,000 points per second, this autocorrelation will choose the closest pitch period in units of 16,000ths of a second.

Smoothing

Both the Sparse_Smooth, step 32, and Fine_Smooth, step 34, functions operate by performing an infinite impulse response (IIR) filter on the array of autocorrelation values calculated on each pass through the main loop. In the case of the Sparse_Autocorr output data this operation is performed by maintaining an array of MAX_LAGS values as history data, scaling this history array by a filtering coefficient, and adding the result to the current array of Sparse_Autocorr values. In the case of the Fine_Autocorr output data this operation is performed by maintaining an array of MAX_LAGS values as history data, scaling this history array by the same filtering coefficient, and adding the result to the current array of Fine_Autocorr values.

The following C programming language code fragment details the algorithm embodiment required for both the Sparse_Smooth, step 32, and Fine_Smooth, step 34, functions.

```
2   float sparse_hist[MAX_LAGS];
4   float fine_hist[5];
6   float coef = 0.90;
10
12  void sparse_smooth()
14  {
16    int i;
18    for(i=0; i < MAX_LAGS; i++)
20    {
22      sparse_hist[i] = R[i] + sparse_hist[i]*coef;
```

-continued

```
24    }
26  }
28
30  void fine_smooth()
32  {
34    int i;
36    for (i=0; i < 5; i++)
38    {
40      fine_hist[i] = F[i] + fine_hist[i]*coef;
42    }
44  }
```

On line 2, a history buffer for smoothed sparse autocorrelation values is declared. On line 4, a history buffer for smoothed fine autocorrelation values is declared. On line 6, a static coefficient is declared and set to a typical smoothing response value of 0.90.

On line 12, a function is declared to provide smoothing of the R[] array which is the output of the Sparse_Autocorr function. On line 18, a loop is executed to perform the smoothing of the R[] array for MAX_LAGS number of elements in the array. On line 22, each current element of the sparse_hist[] array is computed as the sum of the current ith lag value of the sparse autocorrelation, R[i], plus the IIR filter coefficient times the previous value in the sparse_hist[] array.

On line 30, a function is declared to provide smoothing of the F[] array which is the output of the Fine_Autocorr function. On line 36, a loop is executed to perform the smoothing of the F[] array for 5 number of elements in the array. On line 40, each current element of the fine_hist[] array is computed as the sum of the current ith lag value of the fine autocorrelation, F[i], plus the IIR filter coefficient times the previous value in the fine_hist[] array.

Fine Peak Estimator

Figure 13:
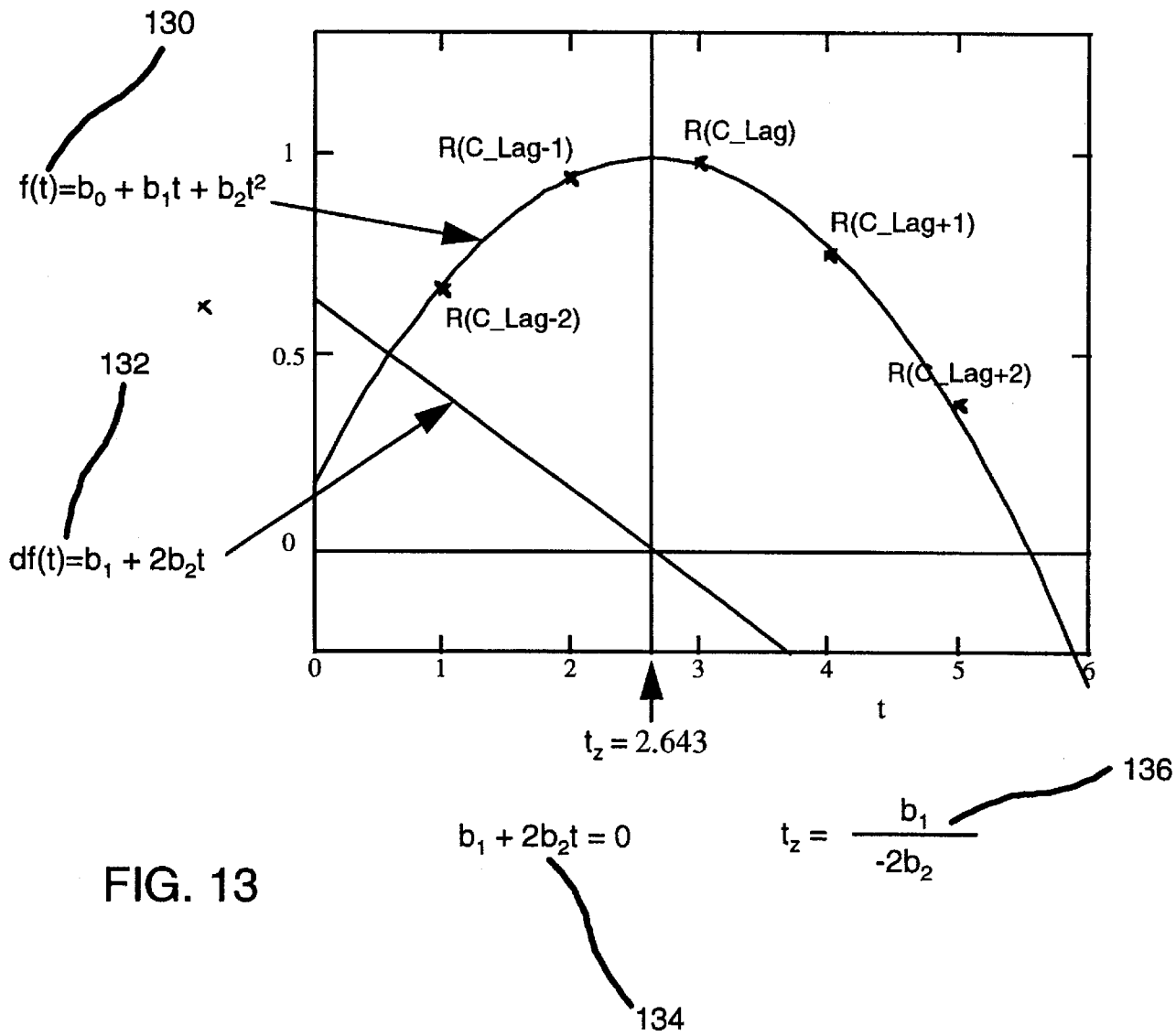
FIG. 13 is a diagram that shows graphically the fine pitch peak estimation process using a quadratic polynomial line of best fit through 5 autocorrelation lag amplitude estimates.

The Peak_Estimator function, step 36, locates a fractional resolution pitch period value by operating on the 5 smoothed fine autocorrelation values, located in the fine_hist[] array. Referring to FIG. 13, this operation is performed by calculating the optimal interpolated peak value location at the point on a quadratic function of best fit 130 to the 5 smoothed fine autocorrelation data points. The optimal peak is determined by setting the derivative of the quadratic function of best fit 132 to zero 134 and solving for the independent range location $t_z$ 136. The following formula incorporates the solution for the polynomial coefficients $b_1$ and $b_2$ and gives $t_z$ for the 5 smoothed data points:

$$t_z = \frac{\sum_{i=0}^{4} \alpha[i] \cdot fine_hist[i]}{\sum_{i=0}^{4} \beta[i] \cdot fine_hist[i]} \quad (1)$$

where $$\alpha^T = [-0.839\ -0.393\ 1.714\ 0.107\ -0.589] \quad (2)$$

and $$\beta^t = [-0.238\ -0.048\ 0.571\ -0.048\ -0.238] \quad (3)$$

(Note: the "T" superscript denotes a vector transpose )

The following C programming language code fragment details the algorithm embodiment required for Peak_Estimator, step 36, function.

```
2   float a[] = {-0.839, -0.393, 1.714, 0.107, -0.589 };
4   float b[] = {-0.238, -0.048, 0.571, -0.048, -0.238 };
6
8   float peak_estimator()
10  {
12    int i;
14    float p, q, tz, fine_pitch;
16    p = 0; q = 0;
18    for(i=0; i < 5; i++)
20    {
22      p = p + a[i]*fine_hist[i];
24      q = q + b[i]*fine_hist[i];
26    }
28    tz = p/q;
30    fine_pitch = coarse_pitch_lag + 3.0 - tz;
32    return(fine_pitch);
34  }
```

On line 2, an alpha array of coefficients are declared and initialized. On line 4, a beta array of coefficients are declared and initialized. On line 8, a function for the Peak Estimator is declared to return a fine pitch estimate. On line 12, a counting variable i is declared. On line 14, temporary variables p and q are declared as well as tz (time of zero crossing) and fine_pitch (final high resolution pitch variable). On line 16, variables p and q are cleared each time the function is called. On line 18, a loop is set up to make exactly 5 passes. On line 22, the numerator (p) of equation (1) is calculated after 5 iterations through the loop. On line 24, the denominator (q) of equation (1) is calculated after 5 iterations through the loop. On line 28, tz is calculated following the calculation of p and q. On line 30, the return value fine_pitch is calculated by adding 3.0 to the coarse_pitch_lag value and then subtracting the value of tz.

Energy Filter

The Energy_Filter function, step 38, is functionally the exact same type of FIR filter as the Pluck_Noise_Filter, step 25, with a different set of coefficients. Also, because the Energy_Filter, step 38, is only called every 16 times through the main loop, the effective sample rate is only 1 KHz when the input sample rate is 16 KHz. The lowpass filter operation required for the $Energy_{13}$ Filter, step 38, is functionally the same as the Pluck_Noise_Filter, but with coefficients selected to give a low pass cut off beginning at about 50 Hz and stopping frequencies above 80 Hz. The unfiltered version of this signal is not used because of the shortness of the window of data observed during the autocorrelation process. This shortness leads to leakage of higher unwanted fundamental frequencies leaking through the autocorrelation process into the energy estimate.

Energy Processor

Figure 9:
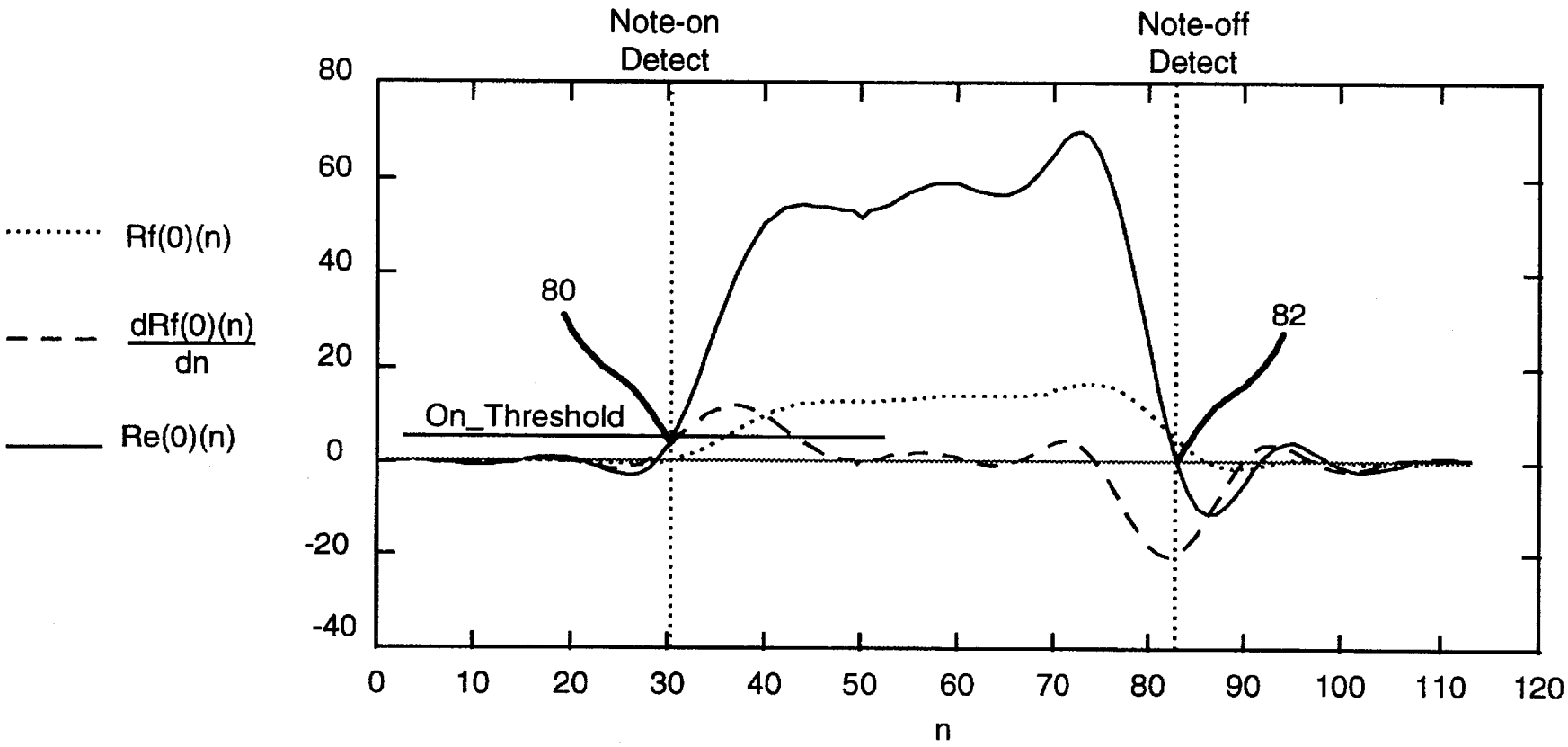
FIG. 9 is a diagram showing the instantaneous energy of the guitar signal data, its derivative, and a combined signal which is the sum of the instantaneous energy signal and a scaled version of the derivative.

The Energy_Process function, step 40, further processes the instantaneous signal energy estimate obtained as an output of the Energy_Filter, step 38. This is done by combining a derivative estimate, scaled by a suitable factor, plus the instantaneous signal energy estimate. Referring to FIG. 9, there are three waveforms graphed against one another in time to show the relative behavior of the Energy_Process function, step 40. The instantaneous signal energy estimate Rf(0) as a function of n is shown on the dotted line. The derivative of Rf(0), dRf(0)(n)/dn is shown as the dashed line on the graph. The solid line is a linear combination of the above two signals. The Note-on detect trigger threshold 80 is set at an amplitude level where Re(0)(n) exceeds this value on its monotonic increase to a much larger value. The Note-off detection is performed when Re(0)(n) falls below the zero baseline level.

The following C programming language code fragment details the operation required for the Energy_Process, step 40.

```
2   #define NOTE_ON_THRESHOLD 0.10
3   #define SCALE_FACTOR 4.0
4   BOOL note_state = OFF;
6
8   BOOL energy_process(float Rf0, float drf0)
10  {
12    float Re0;
14
16    Re0 = SCALE_FACTOR * Rf0 + dRf0;
18    if(note_state)
20    {
22      if(Re0 < 0) note_state = OFF;
24    } else
26    {
28      if(Re0 > NOTE_ON_THRESHOLD) note_state = ON;
30    }
32    return(note_state);
34  }
```

On line 2, a preferred threshold, for determining when a note-on has occurred, is defined as 0.1. On line 3, a preferred scale factor of 4 is defined for scaling the relative amplitude of the instantaneous energy signal to the derivative of the instantaneous energy signal. On line 4, a BOOLEAN integer note_state is declared and initialized to FALSE. On line 8, the energy_process function is declared and both the instantaneous energy signal and the derivative of the instantaneous energy signal are passed into the function as input arguments. The function returns a BOOLEAN value depending on the note_state. On line 12, a temporary variable Re0 is declared. On line 16, a linear combination of the instantaneous energy signal and the derivative of the instantaneous energy signal is computed. On line 18, the current note_state is tested. If it is OFF, then Re0 is checked to see if it exceeds the NOTE_ON_THRESHOLD. If it does then the note_state is changed to the ON state on line 28. If on line 18, the current note_state is ON, then Re0 is tested for less than 0. If it is negative, then the note_state is changed to the OFF state on line 22.

State Machine, Coarse Peak Locator, and Pitch Event Processor

The final steps to the pitch detection process are State_Machine, step 42, which includes the Coarse Peak Locator function 17, and Pitch_Event_Process, step 44. The Pitch_Event_Process is a process of formatting discrete pitch information such as the fine_pitch estimate into a suitable output standard format and its details are not relevant to the present invention. The purpose of showing it in step 44 is to highlight that this operation can take place in a different time slot from the other tasks that share the Op_count, and that this last step also resets the Op_count to 0. Note that the DETECT state in the following code fragment is where the Coarse_Peak_Locator 17 function is calculated.

```
2   int pitch_state = IDLE;
4
6   void state_machine()
8   {
9     float x;
10    int lag_index, i;
12    switch(pitch_state)
14    {
16      case IDLE:
18        if(note_state == ON) pitch_state = DETECT;
20        break;
22
24      case DETECT:
26        x = 0; lag_index = 0;
28        for(i=1; i < MAX_LAGS; i++)
30        {
32          if(sparse_hist[i] > x)
34          {
36            x = sparse_hist[i];
38            lag_index = 1;
40          }
42        }
44        coarse_pitch_lag = (int) (autocor_lags[lag_index] + 0.5);
46        pitch_state = TRACK;
48        break;
50
52      case TRACK;
54        if(note_state == OFF)
56        {
58          pitch_state = IDLE;
60          coarse_pitch_lag = -1;
62        }
64        break;
66    }
68  }
```

On line 2, a pitch_state variable is declared and set to the IDLE condition. On line 6, a function is declared for the State_Machine. On line 10, a lag_index is declared. On line 12, a state machine switch control is executed and each case is executed depending on the pitch_state. On line 16, the IDLE case is executed and the State_Machine remains in this state until a valid NOTE_ON state is reached in the note_state variable. On line 18, the pitch_state advances to the DETECT state. The DETECT state performs the Coarse Peak Locator function 17. On line 24, the DETECT state case is executed on a different pass through this function from the IDLE or TRACK state. On line 26, some search variables x and lag_index are cleared. On line 28, a loop is executed for MAX_LAGS-1 times and starting at the index of 1. On line 32, the current smoothed sparse autocorrelation value sparse_hist[i] is compared against the search variable x to see if it is greater than x. If it is, on lines 36 and 38, the index is captured whenever the value in the sparse_hist[i] array is greater than the previous value of x. Continuing the process for the duration of the loop count ensures that the peak value of sparse_hist[i] is located as well as the corresponding index. On line 44, the coarse_pitch_lag is computed by looking up the value in the autocor_lags[]table and rounding to the nearest integer lag value. On line 46, the pitch_state is set to TRACK where the note_state is monitored on lines 54 until it goes OFF. This returns the State_Machine back to the IDLE state after the coarse_pitch_lag is set to −1 for the fine_pitch state machine shown earlier.

I claim:

1. A method for receiving an electric signal including a primary pitch within the range of music for the human ear and generating data specifying the primary pitch, comprising:

(a) comparing a sample of the signal to each of a plurality of lag adjusted copies of the sample of the signal, (b) selecting the lag adjusted copy which most closely matches the sample of the signal, and (c) specifying the pitch which corresponds to the lag of the selected lag adjusted copy.

2. The method of claim 1 performed at a speed which yields a specified pitch for a received signal within 10 milliseconds after the onset of the signal.

3. The method of claim 1 in which the sample is digitized into a plurality of data points, including a first data point, and the comparison step for each lag adjusted copy is performed by multiplying each of the data points of the sample with the corresponding data point of the lag adjusted copy and summing the multiplication products to yield, for the sample, a lag value for each lag, which lag value is a measure of the closeness of the match for that lag.

4. The method of claim 3 further comprising:

(a) receiving from the electric signal an additional digitized data point;

(b) adding the additional digitized data point to the sample as a new last data point and deleting the first data point in the sample, thereby producing a second sample; and (c) again calculating, for each of the same plurality of lags calculated for the sample, a lag value which is a measure of the closeness of the match for that lag for the second sample, by:

(d) for a lag adjusted copy which is adjusted by n data points from the second sample, subtracting from the nth data point lag value for the sample the product of the first data point of the sample and the nth data point of the sample, and adding the product of the last data point of the second sample and the nth from last data point of the second sample.

5. The method of claim 1 in which the plurality of lag adjusted copies is selected to be fewer than 40 per octave.

6. The method of claim 5 in which the lag adjusted copies are each selected to correspond to an expected pitch.

7. The method of claim 6 in which the expected pitches correspond to proper tunings of musical notes.

8. The method of claim 5 further comprising:

(a) comparing a sample of the signal for fine determination to each of a plurality of lag adjusted copies of the sample of the signal for fine determination, (b) selecting the lag adjusted copy for fine determination which most closely matches the sample of the signal for fine determination, and (c) specifying the pitch which corresponds to the lag of the selected lag adjusted copy for fine determination.

9. The method of claim 5 further comprising:

(a) comparing a sample of the signal for fine determination to each of a plurality of lag adjusted copies of the sample of the signal for fine determination, (b) computing a plurality of values, each of which measures how closely one of the lag adjusted copies for fine determination matches the sample of the signal for fine determination, (c) computing a mathematical curve which closely fits the values, and (d) specifying the pitch which corresponds to the mathematical curve.

10. The method of claim 1 further comprising:

(a) performing the steps of claim 1 a plurality of times, each with a successive sample over time, and collecting over time a plurality of successive specified pitches, (b) comparing the collected successive pitches to each other, and (c) temporally smoothing the collected pitches to yield a temporally smoothed pitch.

11. The method of claim 1 further comprising:

(a) performing steps (a) and (b) of claim 1 a plurality of times, each with a successive sample over time, and collecting over time a plurality of successive selected lags, (b) comparing the collected lags to each other, and (c) temporally smoothing the collected lags to yield a temporally smoothed lag before proceeding to step (c) of claim 1.

12. A method for receiving an electric signal including a primary pitch within the range of music for the human ear and generating data specifying the primary pitch, comprising:

(a) comparing a sample of the signal to each of a plurality of lag adjusted copies of the sample of the signal, (b) computing a plurality of values, each of which measures how closely one of the lag adjusted copies matches the sample of the signal, (c) computing a mathematical curve which corresponds to the values, and (d) specifying the pitch which corresponds to the mathematical curve.

13. The method of claim 12 further comprising:

(a) performing the steps of claim 12 a plurality of times, each with a successive sample over time, and collecting over time a plurality of successive pitches, (b) comparing the collected pitches to each other, and (c) temporally smoothing the collected pitches to yield a temporally smoothed pitch.

14. The method of claim 12 further comprising:

(a) performing steps (a) and (b) of claim 12 a plurality of times, each with a successive sample over time, and collecting over time a plurality of successive sets of values, (b) comparing the collected sets of values to each other, and (c) temporally smoothing the collected sets of values to yield a temporally smoothed set of values before proceeding to steps (c) and (d).

15. The method of claim 12 which is performed at a speed which yields a specified pitch for a received signal within 10 milliseconds after the onset of the signal.

16. A computer readable medium containing a computer program for causing a computer to receive an electric signal including a primary pitch within the range of music for the human ear and generate data specifying the primary pitch, comprising the steps of:

(a) comparing a sample of the signal to each of a plurality of lag adjusted copies of the sample of the signal, (b) selecting the lag adjusted copy which most closely matches the sample of the signal, and (c) specifying the pitch which corresponds to the lag of the selected lag adjusted copy.

17. The computer readable medium containing a computer program of claim 16 which causes a computer to perform the steps of claim 16 at a speed which yields a specified pitch for a received signal within 10 milliseconds after the onset of the signal.

18. The computer readable medium containing a computer program of claim 16 in which the sample is digitized into a plurality of data points, including a first data point, and the comparison step for each lag adjusted copy is performed by multiplying each of the data points of the sample with the corresponding data point of the lag adjusted copy and summing the multiplication products to yield, for the sample, a lag value for each lag, which lag value is a measure of the closeness of the match for that lag.

19. The computer readable medium containing a computer program of claim 18 further comprising the steps of:

(a) receiving from the electric signal an additional digitized data point;

(b) adding the additional digitized data point to the sample as a new last data point and deleting the first data point in the sample, thereby producing a second sample; and (c) again calculating, for each of the same plurality of lags calculated for the sample, a lag value which is a measure of the closeness of the match for that lag for the second sample, by:

(d) for a lag adjusted copy which is adjusted by n data points from the second sample, subtracting from the nth data point lag value for the sample the product of the first data point of the sample and the nth data point of the sample, and adding the product of the last data point of the second sample and the nth from last data point of the second sample.

20. The computer readable medium containing a computer program of claim 16 in which the plurality of lag adjusted copies is selected to be fewer than 40 per octave.

21. The computer readable medium containing a computer program of claim 20 in which the lag adjusted copies are each selected to correspond to an expected pitch.

22. The computer readable medium containing a computer program of claim 21 in which the expected pitches correspond to proper tunings of musical notes.

23. The computer readable medium containing a computer program of claim 20 further comprising the steps of:

(a) comparing a sample of the signal for fine determination to each of a plurality of lag adjusted copies of the sample of the signal for fine determination, (b) selecting the lag adjusted copy for fine determination which most closely matches the sample of the signal for fine determination, and (c) specifying the pitch which corresponds to the lag of the selected lag adjusted copy for fine determination.

24. The computer readable medium containing a computer program of claim 20 further comprising the steps of:

(a) comparing a sample of the signal for fine determination to each of a plurality of lag adjusted copies of the sample of the signal for fine determination, (b) computing a plurality of values, each of which measures how closely one of the lag adjusted copies for fine determination matches the sample of the signal for fine determination, (c) computing a mathematical curve which closely fits the values, and (d) specifying the pitch which corresponds to the mathematical curve.

25. The computer readable medium containing a computer program of claim 16 further comprising the steps of:

(a) performing the steps of claim 16 a plurality of times, each with a successive sample over time, and collecting over time a plurality of successive specified pitches, (b) comparing the collected successive pitches to each other, and (c) temporally smoothing the collected pitches to yield a temporally smoothed pitch.

26. The computer readable medium containing a computer program of claim 16 further comprising the steps of:

(a) performing steps (a) and (b) of claim 16 a plurality of times, each with a successive sample over time, and collecting over time a plurality of successive selected lags, (b) comparing the collected lags to each other, and (c) temporally smoothing the collected lags to yield a temporally smoothed lag before proceeding to step (c) of claim 16.

27. A computer readable medium containing a computer program for causing a computer to receive an electric signal including a primary pitch within the range of music for the human ear and generate data specifying the primary pitch, comprising the steps of:

(a) comparing a sample of the signal to each of a plurality of lag adjusted copies of the sample of the signal, (b) computing a plurality of values, each of which measures how closely one of the lag adjusted copies matches the sample of the signal, (c) computing a mathematical curve which corresponds to the values, and (d) specifying the pitch which corresponds to the mathematical curve.

28. The computer readable medium containing a computer program of claim 27 further comprising the steps of:

(a) performing the steps of claim 27 a plurality of times, each with a successive sample over time, and collecting over time a plurality of successive pitches, (b) comparing the collected pitches to each other, and (c) temporally smoothing the collected pitches to yield a temporally smoothed pitch.

29. The computer readable medium containing a computer program of claim 27 further comprising the steps of:

(a) performing steps (a) and (b) of claim 27 a plurality of times, each with a successive sample over time, and collecting over time a plurality of successive sets of values, (b) comparing the collected sets of values to each other, and (c) temporally smoothing the collected sets of values to yield a temporally smoothed set of values before proceeding to steps (c) and (d).

30. The computer readable medium containing a computer program of claim 27 which causes a computer to perform at a speed which yields a specified pitch for a received signal within milliseconds after the onset of the signal.

31. An electronic device for receiving an electric signal including a primary pitch within the range of music for the human ear and generating data specifying the primary pitch, comprising:

(a) comparison means for comparing a sample of the signal to a plurality of lag adjusted copies of the sample of the signal, (b) means for selecting the lag adjusted copy which most closely matches the sample of the signal, and (c) means for specifying the pitch which corresponds to the lag of the selected lag adjusted copy.

32. The device of claim 31 which operates at a speed which yields a specified pitch for a received signal within 10 milliseconds after the onset of the signal.

33. The device of claim 31 further comprising means for digitizing the sample into a plurality of data points, including a first data point, and, for each lag adjusted copy, the comparison means multiplies each of the data points of the sample with the corresponding data point of the lag adjusted copy and sums the multiplication products to yield, for the sample, a lag value for each lag, which lag value is a measure of the closeness of the match for that lag.

34. The device of claim 33 further comprising:

(a) means for receiving from the electric signal an additional digitized data point;

(b) means for adding the additional digitized data point to the sample as a new last data point and deleting the data point in the first sample, thereby producing a second sample; and (c) means for again calculating, for each of the same plurality of lags calculated for the sample, a lag value which is a measure of the closeness of the match for that lag for the second sample, by:

(d) for a lag adjusted copy which is adjusted by n data points from the second sample, subtracting from the nth data point lag value for the sample the product of the first data point of the sample and the nth data point of the sample, and adding the product of the last data point of the second sample and the nth from last data point of the second sample.

35. The device of claim 31 in which the plurality of lag adjusted copies is selected to be fewer than 40 per octave.

36. The device of claim 35 in which the comparison means uses lag adjusted copies which are selected to correspond to expected pitches.

37. The device of claim 36 in which the expected pitches correspond to proper tunings of musical notes.

38. The device of claim 35 further comprising:

(a) means for comparing a sample of the signal for fine determination to each of a plurality of lag adjusted copies of the sample of the signal for fine determination, (b) means for selecting the lag adjusted copy for fine determination which most closely matches the sample of the signal for fine determination, and (c) means for specifying the pitch which corresponds to the lag of the selected lag adjusted copy for fine determination.

39. The device of claim 35 further comprising:

(a) means for comparing a sample of the signal for fine determination to each of a plurality of lag adjusted copies of the sample of the signal for fine determination, (b) means for computing a plurality of values, each of which measures how closely one of the lag adjusted copies for fine determination matches the sample of the signal for fine determination, (c) means for computing a mathematical curve which closely fits the values, and (d) means for specifying the pitch which corresponds to the mathematical curve.

40. The device of claim 31 further comprising:

(a) means for invoking the means of claim 31 a plurality of times, each with a successive sample over time, and collecting over time a plurality of successive specified pitches, (b) means for comparing the collected successive pitches to each other, and (c) means for temporally smoothing the collected pitches to yield a temporally smoothed pitch.

41. The device of claim 31 further comprising:

(a) means for invoking means (a) and (b) of claim 31 a plurality of times, each with a successive sample over time, and collecting over time a plurality of successive selected lags, (b) means for comparing the collected lags to each other, and (c) means for temporally smoothing the collected lags to yield a temporally smoothed lag before invoking means (c) of claim 31.

42. An electronic device for receiving an electric signal including a primary pitch and generating data specifying the primary pitch, comprising:

(a) means for comparing a sample of the signal to a plurality of lag adjusted copies of the sample of the signal, (b) means for computing a plurality of values, each of which measures how closely a lag adjusted copy matches the sample of the signal, (c) means for computing a mathematical curve which corresponds to the values, and (d) means for specifying the pitch which corresponds to the mathematical curve.

43. The device of claim 42 further comprising:

(a) means for invoking the means of claim 42 a plurality of times, each with a successive sample over time, and collecting over time a plurality of successive pitches, (b) means for comparing the collected pitches to each other, and (c) means for temporally smoothing the collected pitches to yield a temporally smoothed pitch.

44. The device of claim 42 further comprising:

(a) means for invoking means (a) and (b) of claim 42 a plurality of times, each with a successive sample over time, and collecting over time a plurality of successive sets of values, (b) means for comparing the collected sets of values to each other, and (c) means for temporally smoothing the collected sets of values to yield a temporally smoothed set of values before proceeding to means (c) and (d).

45. The device of claim 42 which operates at a speed which yields a specified pitch for a received signal within 10 milliseconds after the onset of the signal.

* * * * *